US011191418B1

(12) United States Patent
Stein et al.

(10) Patent No.: US 11,191,418 B1
(45) **Date of Patent: *Dec. 7, 2021**

(54) CLEANING APPARATUS AND SYSTEM FOR PLATES AND UTENSILS

(71) Applicant: P.S. Creations LLC, Atascadero, CA (US)

(72) Inventors: Nathan Stephen Stein, Atascadero, CA (US); Ryan Ronald Kruse, Atascadero, CA (US); Robert Carl Swanland, San Luis Obispo, CA (US)

(73) Assignee: P.S. Creations LLC, San Luis Obispo, CA (US)

( * ) Notice: Subject to any disclaimer, the term of this patent is extended or adjusted under 35 U.S.C. 154(b) by 259 days.

This patent is subject to a terminal disclaimer.

(21) Appl. No.: 16/572,443

(22) Filed: Sep. 16, 2019

Related U.S. Application Data

(63) Continuation-in-part of application No. 15/495,931, filed on Apr. 24, 2017, now Pat. No. 10,413,154.

(60) Provisional application No. 62/327,819, filed on Apr. 26, 2016.

(51) Int. Cl.

| | |
|---|---|
| ***A47L 17/02*** | (2006.01) |
| ***A46B 11/00*** | (2006.01) |
| ***A47L 15/37*** | (2006.01) |
| ***A46B 15/00*** | (2006.01) |
| ***A47L 21/04*** | (2006.01) |

(52) U.S. Cl.
CPC ..... *A47L 15/37* (2013.01); *A46B 15/0055* (2013.01); *A47L 17/02* (2013.01); *A47L 21/04* (2013.01)

(58) Field of Classification Search
CPC ..... A47L 17/02; A47L 15/37; A47L 21/04; A46B 5/0095; A46B 2200/3033; A46B 15/0055
See application file for complete search history.

(56) References Cited

U.S. PATENT DOCUMENTS

| | | | | | |
|---|---|---|---|---|---|
| 142,480 | A | * | 9/1873 | Kidder | A63B 57/60 15/104.92 |
| 459,927 | A | | 9/1891 | Crees | |
| 2,221,442 | A | | 11/1940 | Cunningham | |
| 3,428,988 | A | * | 2/1969 | Blackburn | B08B 1/00 15/160 |
| 3,513,497 | A | | 5/1970 | Vallverdu | |
| 3,638,268 | A | | 2/1972 | Van Horn | |

(Continued)

*Primary Examiner* — Weilun Lo
(74) *Attorney, Agent, or Firm* — Richard A. Ryan

(57) ABSTRACT

A cleaning apparatus and system for removing debris from a surface of a plate or utensil. The apparatus has a cleaning area and a pair of brushes disposed in the cleaning area with the bristles of a first brush facing toward the bristles of the second brush so that debris is scraped off the surface as the plate or utensil is pushed through the bristles. The cleaning area may be defined by a container or an opening in a work surface. Brush mounting mechanisms mount the brushes to opposing sidewalls of the container or opposing interior surfaces of the opening. The brush mounting mechanisms and brushes can be cooperatively configured so the bristles of the brushes overlap each other where the plate or utensil will be pushed through the bristles. The mounting mechanism may be a clip that engages a sidewall of the container. The system includes the apparatus.

20 Claims, 10 Drawing Sheets

(56) References Cited

U.S. PATENT DOCUMENTS 3,813,722 A * 6/1974 Sapochinik ..... A45D 24/44 15/104.92
4,011,621 A 3/1977 Irvine
4,821,358 A * 4/1989 Wyckoff ..... A63B 57/60 15/104.92
4,879,779 A 11/1989 Zalevsky
5,044,036 A * 9/1991 Fujimoto ..... A47L 4/00 15/88.1
5,081,735 A 1/1992 Wyatt
5,308,406 A * 5/1994 Wallock ..... A61L 2/18 134/42
5,398,363 A 3/1995 Medearis
5,479,674 A 1/1996 Gilcrest
5,652,993 A 8/1997 Kreyer
5,666,684 A * 9/1997 Cussen ..... A63B 57/60 15/104.92
5,794,301 A 8/1998 Hietala
5,997,655 A * 12/1999 Schang ..... B08B 1/00 134/6
6,141,816 A 11/2000 Burnett
6,263,536 B1 7/2001 Beales
6,745,424 B1 6/2004 Pimentel
6,938,296 B1 * 9/2005 Scheuermann ..... A63B 57/60 15/104.92
7,200,891 B1 * 4/2007 McCulloch ..... A46B 7/00 15/104.92
8,607,396 B2 12/2013 Albright
8,938,848 B2 1/2015 Van Landingham, Jr. et al.
8,992,693 B2 * 3/2015 Currell ..... B08B 3/006 134/31
2002/0152568 A1 10/2002 Dillinger
2002/0170132 A1 * 11/2002 Brent ..... A47L 23/02 15/104.92
2005/0273957 A1 12/2005 Boltryk
2011/0179593 A1 * 7/2011 Albright ..... A46B 15/0055 15/159.1

* cited by examiner

CLEANING APPARATUS AND SYSTEM FOR PLATES AND UTENSILS

CROSS-REFERENCE TO RELATED APPLICATIONS

This patent application is a continuation-in-part of U.S. patent application Ser. No. 15/495,931 filed Apr. 24, 2017, which issued as U.S. Pat. No. 10,413,154 on Sep. 17, 2019, which application claimed priority to U.S. Provisional Patent Application Ser. No. 62/327,819 filed Apr. 26, 2016.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The field of the present invention relates generally to apparatuses and systems that are utilized for cleaning individual objects. In particular, the present invention relates to such apparatuses and systems that are specially configured to remove food waste from the surfaces of plates, utensils and like objects to reduce the amount of water, soap, time and other resources required to thoroughly clean such objects. Even more particularly, the present invention relates to such apparatuses and systems that can be utilized as a stand-alone, self-contained cleaning unit or which may be incorporated into other cleaning equipment.

B. Background

A wide variety of apparatuses and systems are specially configured to clean specific types of objects. Often, these cleaning apparatuses and systems are cooperatively sized and configured with a particular object in order to accept and clean the object in an efficient and effective manner. For instance, automated car washes are sized and configured to clean cars and other vehicles in a manner that allows a vehicle to enter the cleaning apparatus, move the vehicle through the apparatus as it cleans the vehicle and dry the vehicle after cleaning. Dish washing machines, whether they are for home or commercial use, are sized and configured to receive standard sizes of dishes, glasses and utensils. As well known, most home dish washing machines have built-in racks that are pulled outward to position the objects on the racks so they will be cleaned by the machine's cleaning system. Commercial dish washing machines are configured to insertably receive removable racks that have dishes positioned on the racks.

Most specially configured cleaning apparatuses and systems utilize relatively large amounts of water that is sprayed, often at relatively high pressure, against the object to be cleaned. These cleaning apparatuses and systems also utilize soap to clean the object and electricity, or in some circumstances gas, to power the various components of the cleaning apparatus. Because the cost of operating cleaning apparatuses can be somewhat high, most users of such apparatuses and cleaning systems desire that the apparatus be as effective and efficient as possible to limit unnecessary expenditures for cleaning. Wasted resources from inefficient and/or ineffective cleaning typically also requires a greater use of human resources. To reduce cost and limit wasted resources, many cleaning systems utilize a pre-wash procedure to improve the efficiency and effectiveness of the primary cleaning operation. As an example, many car washing and dish washing systems utilize an initial cleaning procedure to remove items that may be stuck to the object (i.e., car or dishes) that will be washed by the apparatus so as to improve the effectiveness of the cleaning operation.

With regard to cleaning apparatuses and systems that are specially configured to clean dishes, glasses and utensils (which includes, but is not limited to knives, forks, spoons, spatulas, tongs, whisks, ladles, skewers, cleavers and other implements that are or can be utilized for preparing, cooking and eating food) that are utilized with food, the cleaning apparatuses must be configured to remove food-related waste from the object to be cleaned. As well known, food waste that is allowed to dry on a dish, glass or utensil will be much harder to remove from the object than food which has not dried. Being hard to remove is very likely to decrease the efficiency and overall effectiveness of the cleaning apparatus, which often results in an increase in the amount of wash time (or repeated washing) for the object. As set forth above, this results in an increased use of water, soap, electricity and/or gas (i.e., for heating the water) and human resources, which then results in higher costs. As a result, most people will rinse or pre-wash food-related objects in a sink or like area to remove as much of the loose food waste as possible from the object before they place the object in the dish washing machine. While this process is generally manageable in a home setting, in commercial dish washing operations (such as a restaurant), the pre-washing of the dishes, glasses and utensils is much harder to manage due to a lack of space and the time necessary to accomplish the pre-wash.

Perhaps the most common type of dishes to have problems with dry food waste being hard to remove are plates and utensils, which typically have a generally planar to slightly concave or shapes. One reason for the difficultly with plates and utensils is that they usually have some of the most "messy" types of foods left on them. Another reason for the difficultly with plates and utensils is that these items are commonly stacked or otherwise piled on top of and mixed up with each other when waiting to be cleaned in the dish washer. Prior to being placed inside a dish washer, plates and utensils are usually pre-cleaned by, at a minimum, directing running water over the dirty surfaces of the plates and utensils. In a commercial environment, plates and utensils are typically pre-cleaned by hand using a combined nozzle/hose to direct pressurized water against the surfaces of a plate or utensil, specially the surface(s) having food waste thereon. In addition, or as an alternative, the person washing the dishes will wipe the surfaces of the plate or utensil with a scraper, scraping pad, dish rag or a protective glove on his or her hand to remove food waste from the surfaces of the plate or utensil. If the food has hardened and, therefore, become adhered to a surface of the plate or utensil, the spraying and/or hand wiping of the dirty surfaces can take some time and effort. In some circumstances, pre-cleaning removal of dried food waste from a plate or utensil requires soaking the plate or utensil in water. As will be appreciated by persons who are skilled in the relevant art, the pre-washing of plates and utensils to remove food waste, whether hardened or not, takes time and utilizes water and electricity/gas power resources. If the food waste is dried on the surface of the plate or utensil, this necessarily increases the amount of time, water and power resources that it takes to pre-wash the plate or utensil.

What is needed, therefore, is an improved apparatus and system for cleaning plates and utensils that can be utilized to more efficiently remove food waste from the surfaces of a plate or utensil. Preferably, the new apparatus and system for cleaning plates and utensils should be configured to effectively remove food waste from the surfaces of a plate or utensil to reduce the amount of time and resources that would otherwise be required to fully clean the plate or utensil, such as placing the plate or utensil in a dish washing machine. The new apparatus and system of the present invention should be configured to be useful for efficiently and effectively cleaning a plate or utensil that has dried food waste on one or more of the surfaces of the plate or utensil to avoid the need for scraping, wiping, spraying, soaking and/or various other pre-cleaning methods of removing food waste from the plate or utensil before washing the plate or utensil in a dish washing machine or by other wash processes. Preferably, the new apparatus and system should be configured to reduce the cost and time required to pre-clean plates and utensils prior to placing the plates and utensils in a dish washing machine or otherwise fully cleaning the plates and utensils. Preferably, the new apparatus and system should be easy to use, adaptable to a wide range of sizes and configurations of plates and utensils and be relatively inexpensive to manufacture.

SUMMARY OF THE INVENTION

The following presents a simplified summary of the disclosure in order to provide a basic understanding to the reader. As such, this Summary is not an extensive overview of the disclosure and it does not identify key/critical elements of the invention or delineate the scope of the invention. The sole purpose of this Summary is to present some concepts disclosed herein in a simplified form as a prelude to the more detailed description that is presented later. A more complete appreciation of the present invention and the scope thereof can be obtained from the accompanying drawings which are briefly summarized below and the following detailed description of the presently preferred embodiments of the present invention.

The cleaning apparatus and system of the present invention provides the benefits and solves the problems identified above. That is to say, the cleaning apparatus and system of the present invention is structured and arranged to easily, effectively and efficiently remove food waste from the surfaces of plates and utensils. More specifically, the new cleaning apparatus and system of the present invention is configured to remove food waste from the surfaces of a plate or utensil in order to reduce the amount of time and resources that would otherwise be required to fully clean the plate or utensil in a dish washing machine or by other methods (including hand-washing). The new cleaning apparatus and system are particularly useful for quickly, efficiently and effectively pre-cleaning a plate or utensil that has dried food waste on one or more of the surfaces so as to eliminate the need for scraping, wiping, spraying, soaking and/or various other pre-cleaning methods of removing food waste from a plate or utensil before the plate or utensil is washed in a dish washing machine or by other plate washing processes. The new cleaning apparatus and system can be utilized as a stand-alone unit or it may be incorporated into a table, shelf or like component of a dish washing system. In one embodiment, the new cleaning apparatus and system comprises a bucket or other container having opposing sidewalls, a pair of brushes and a brush mounting mechanism that is structured and arranged to mount one of the pair of brushes on each of the opposite sidewalls so the bristles of one brush face the bristles of the other brush, in some configurations in overlapping relation, so the surfaces of a plate or utensil will be cleaned when the plate or utensil is pushed down between the two brushes. As will be readily appreciated by persons who are skilled in the art, the new cleaning apparatus and system reduces the cost and time required to pre-clean a plate or utensil prior to placing the plate or utensil in a dish washing machine or otherwise fully cleaning the plate or utensil. In one of the preferred embodiments, the new cleaning apparatus and system are easy to use, adaptable to a wide range of sizes and configurations of plates and utensils and which are relatively inexpensive to manufacture and use.

In one embodiment of the present invention, the cleaning apparatus generally comprises a cleaning area defined by a container having one or more sidewalls or an opening in a work surface, a first brush having a brush body with a plurality of outwardly extending bristles, a second brush having a brush body with a plurality of outwardly extending bristles, a first brush mounting mechanism that is associated with the first brush for mounting the first brush in the cleaning area and a second brush mounting mechanism that is associated with the second brush for mounting the second brush in the cleaning area. The bristles of each brush has a proximal end at the brush body and a distal end that extends outwardly from the brush body. The first and second brush mounting mechanism are cooperatively structured and arranged to dispose the bristles of the first brush generally toward the bristles of the second brush when each of the first brush and the second brush are placed in the cleaning area such that when a user pushes a plate or utensil through the bristles of the first brush and the second brush the bristles of at least one of the two brushes will remove the debris, such as food debris, from the surface of the plate or utensil. In an embodiment where the cleaning area is defined by the container, each of the first and second brush mounting mechanism comprise a container engaging section that is structured and arranged to engage opposite facing sidewalls of the container to position the bristles of the first brush and in opposing relation to the bristles of the second brush in the cleaning area. In one of the preferred configurations, the first brush mounting mechanism and the second brush mounting mechanism are cooperatively configured with the first brush and the second brush to define an overlap area wherein the distal ends of the bristles of the first brush are disposed in the bristles of the second brush and the distal ends of the bristles of the second brush are disposed in the bristles of the first brush when the two brushes are disposed in the cleaning area of the container and the opening. Often, depending on the configuration of the plate or utensil, this configuration may be more effective at cleaning the dirty surface or surfaces of the plate or utensil.

In one embodiment, each of the first brush mounting mechanism and the second brush mounting mechanism comprise clip devices that are structured and arranged to secure either he first brush or the second brush to a sidewall of the container that defines the cleaning area. The clip device has a brush engaging section and a container engaging section, with the brush engaging section being sized and configured to engage either the first brush or the second brush and the container engaging section having a first clip member and a second clip member that define a wall engaging area therebetween that is sized and configured to receive a sidewall therein so as to secure either the first brush or the second brush to the container. In one of the preferred configurations, the cleaning apparatus and system comprises a clip securing mechanism that is associated with each of the clip devices and the container. The clip securing mechanism can be a bolt, screw or like connector that connects a clip device to a sidewall of the container or it can comprise a clip protrusion that extends into the wall engaging area to engage a wall aperture in the sidewall of the container.

In the embodiment where the cleaning area is defined by an opening in a work surface, each of the first brush mounting mechanism and the second brush mounting mechanism include an attaching mechanism that is structured and arranged to attach the first and second brush mounting mechanism to opposing interior surfaces of the opening so as to position the bristles of the first brush in opposing relation to the bristles of the second brush in the cleaning area.

Accordingly, the primary object of the present invention is to provide a new cleaning apparatus and system that has the advantages set forth above and which overcomes the disadvantages and limitations that are associated with presently available methods of cleaning or pre-cleaning plates and utensils.

It is an important object of the present invention to provide a new cleaning apparatus and system that is structured and arranged to more easily, effectively and efficiently remove food waste, particularly dried food waste, from the surfaces of a plate or utensil in order to reduce the amount of time and resources that would otherwise be required to completely clean the plate or utensil, such as placing the plate or utensil in a dish washing machine or other cleaning processes.

An important aspect of the present invention is that it provides a new cleaning apparatus and system that accomplishes the objectives set forth above and elsewhere in the present disclosure.

Another important aspect of the present invention is that it provides a new cleaning apparatus and system that are structured and arranged to more easily, effectively and efficiently remove food waste and other debris from the surfaces of a plate or utensil.

Another important aspect of the present invention is that it provides a new cleaning apparatus and system that are configured to remove food waste from the surfaces of a plate or utensil to reduce the amount of time and resources that would otherwise be required to fully clean the plate or utensil in a dish washing machine or by other methods.

Another important aspect of the present invention is that it provides a new cleaning apparatus and system that are particularly useful for quickly, efficiently and effectively pre-cleaning a plate or utensil that has dried food waste on one or more of the surfaces of the plate or utensil so as to eliminate, or at least substantially eliminate, the need for scraping, wiping, spraying, soaking and/or various other pre-cleaning methods of removing food waste from the plate or utensil before the plate or utensil is washed in a dish washing machine or by other washing processes, including hand-washing processes.

Another important aspect of the present invention is that it provides a new cleaning apparatus and system which can be utilized as a stand-alone unit or it may be incorporated into a table, shelf or like component of a dish washing system, with the apparatus and system generally comprising an open cleaning area defined by a container or other object, a pair of brushes and a brush mounting mechanism that mounts the pair of brushes in the open cleaning area with the bristles of one brush facing the bristles of the other brush, preferably in overlapping relation, so a plate or utensil will be cleaned when the plate or utensil is pushed downward between the two brushes, but with a dirty surface in contact with at least one of the two brushes.

Another important aspect of the present invention is that it provides a new cleaning apparatus and system that reduces the cost and time required to pre-clean n a plate or utensil prior to placing the plate or utensil in an automated dish washing machine or otherwise fully cleaning the plate or utensil.

In yet another important aspect of the present invention, the new cleaning apparatus and system that are easy to use, adaptable to a wide range of different sizes and configurations of plates and utensils and relatively inexpensive to manufacture.

As will be explained in greater detail by reference to the attached figures and the description of the preferred embodiment which follows, the above and other objects and aspects are accomplished or provided by the present invention. As set forth herein and will be readily appreciated by those skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the components of the new cleaning apparatus and system of the present invention, as well as the plate or utensil and food waste with which the cleaning apparatus can be utilized, those skilled in the art will readily appreciate that the present invention is not so limited. In addition, the exemplary embodiment of the present apparatus is shown and described herein with only those components that are required to disclose the present invention. As such, many of the necessary mechanical elements for combining components together and for using the present invention are not shown or necessarily described below, but which are well known to persons who are skilled in the relevant art. As will be readily appreciated by such persons, the various elements of the present invention that are described below may take on any form consistent with forms that are readily realized by a person of ordinary skill in the art having knowledge of containers, brushes and attachment mechanisms. In addition, the new apparatus and system may be utilized to clean the surfaces of a wide variety of different types, sizes and shapes of plates and utensils.

Figure 1:
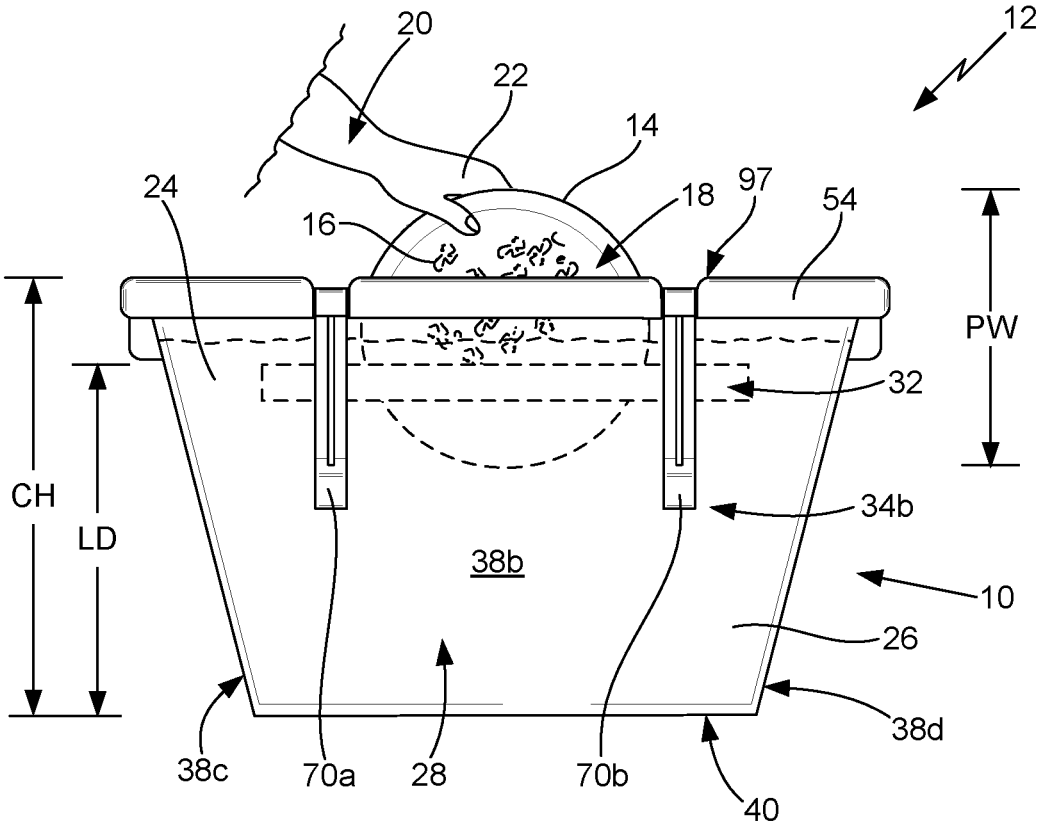
FIG. 1 is a side view of a cleaning system configured according to a first embodiment of the present invention, with the cleaning apparatus comprising a stand-alone bucket and shown in use cleaning a plate having food waste on a surface of the plate.
Figure 2:
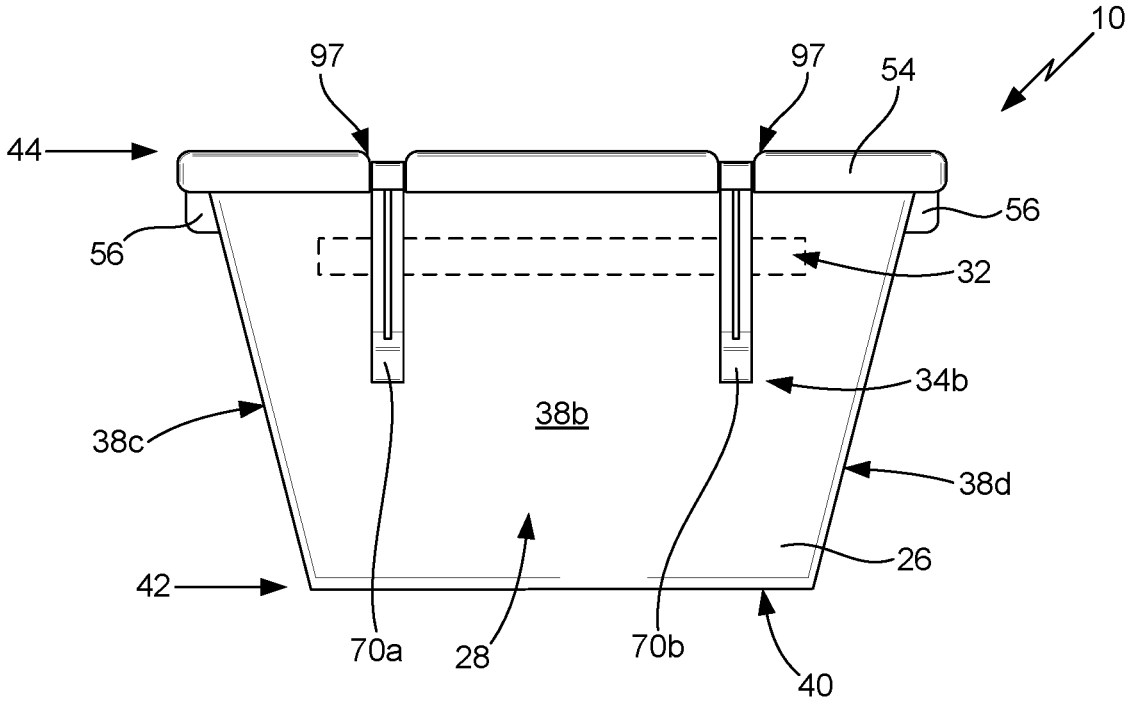
FIG. 2 is a side view of the cleaning apparatus of FIG. 1 shown without the water in the bucket and without the user inserting the plate into the apparatus.
Figure 19:
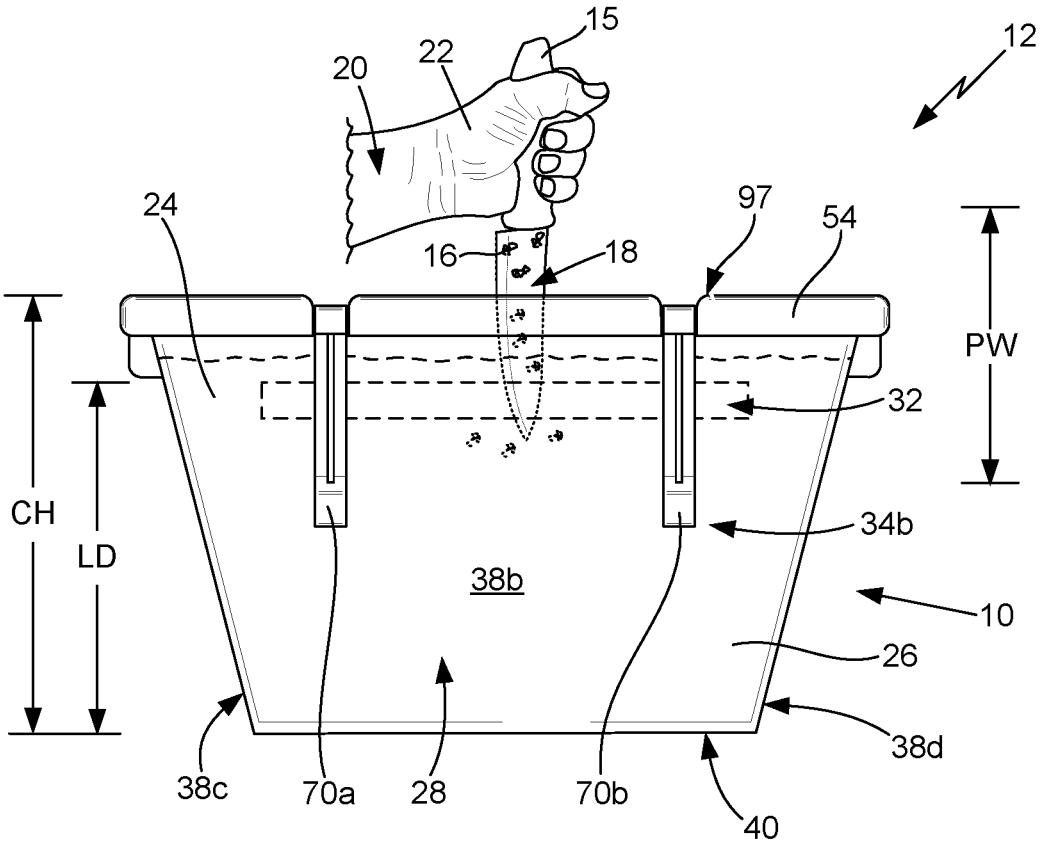
FIG. 19 is a side view of the cleaning system of the present invention, with the cleaning apparatus comprising a stand-alone container and shown in use cleaning a utensil (a knife) having food waste on a surface of the utensil.

A cleaning apparatus that is configured pursuant to one of the preferred embodiments of the present invention is referred to generally as 10 in FIGS. 1-4 and 12-14. A cleaning system that utilizes the cleaning apparatus 10 is shown as 12 in FIG. 1. As set forth in more detail below, the cleaning apparatus 10 and system 12 of the present invention are particularly useful for cleaning plates 14 or utensils 15, examples of which are shown in FIGS. 1 and 19, that have food debris 16 on one or more surfaces 18 of the plate 14 or utensil 15 to reduce the time, resources and costs to clean the plate 14 or utensil 15. As shown in use in FIGS. 1 and 15, the user 20 will grasp a plate 14 or utensil 15 having food debris 16 on at least one surface 18 thereof with his or her hand 22 and insert the plate 14 or utensil 15 into the apparatus 10 to remove the food debris 16 from the one or more dirty surface 18 (i.e., the top and bottom surface of the plate 14 or utensil 15). The plate 14 has a plate width, shown as PW in FIG. 1, across which the surface 18 may have food debris 16 thereon. The apparatus 10 will contain a liquid 24, typically water, soapy water or the like, in which a plate 14 or utensil 15 is inserted when using apparatus 10 and system 12. As shown in FIG. 1, the system 12 of the present invention comprises the apparatus 10, plate 14, user 20 and liquid 24. In FIG. 19, the system 12 comprises the apparatus 10, utensil 15, user 20 and liquid 24. For purposes of describing the apparatus 10 and system 12 of the present invention, the plate 14 is any substantially flat or slightly concave shaped plate-like object that can be beneficially cleaned by the apparatus 10, the utensil 15 is any implement, such as knives, forks, spoons, spatulas, tongs, whisks, ladles, skewers, cleavers and the like that are or can be utilized for preparing, cooking and eating food, which can be beneficially cleaned by the apparatus 10 and the food debris 16 can be any type of debris or other matter, whether food or not, that may be on one or more surfaces 18 of the plate 14 and utensil 15 and which needs to be removed to clean the plate 14 or utensil 15 prior to reuse.

Figure 12:
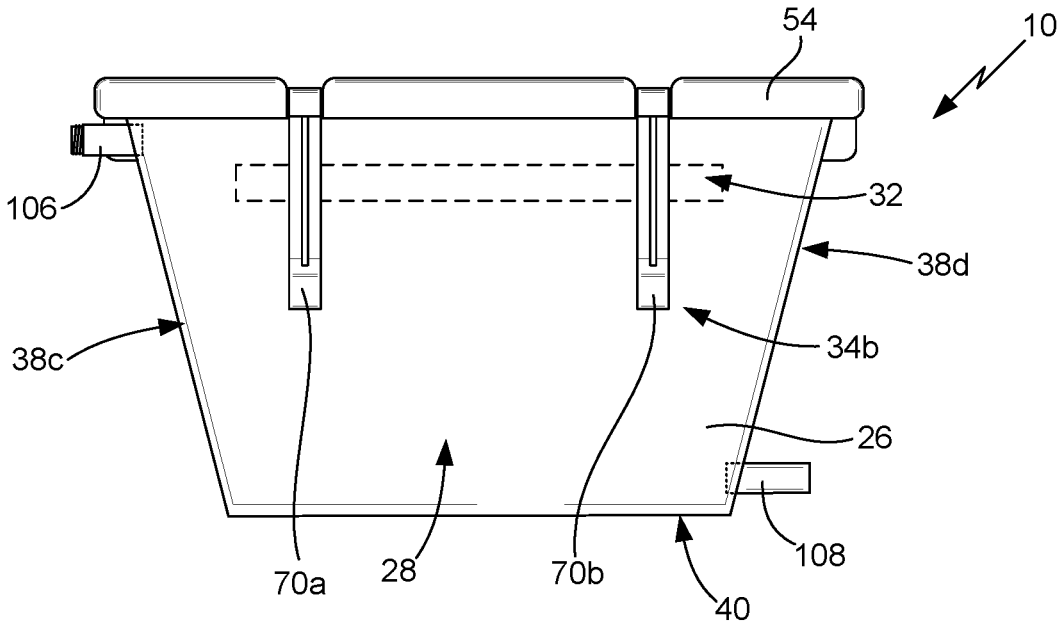
FIG. 12 is a side view of a cleaning apparatus configured according to a second embodiment of the present invention showing the use of an inlet and an outlet to flow water into and out of the cleaning area of the bucket.
Figure 13:
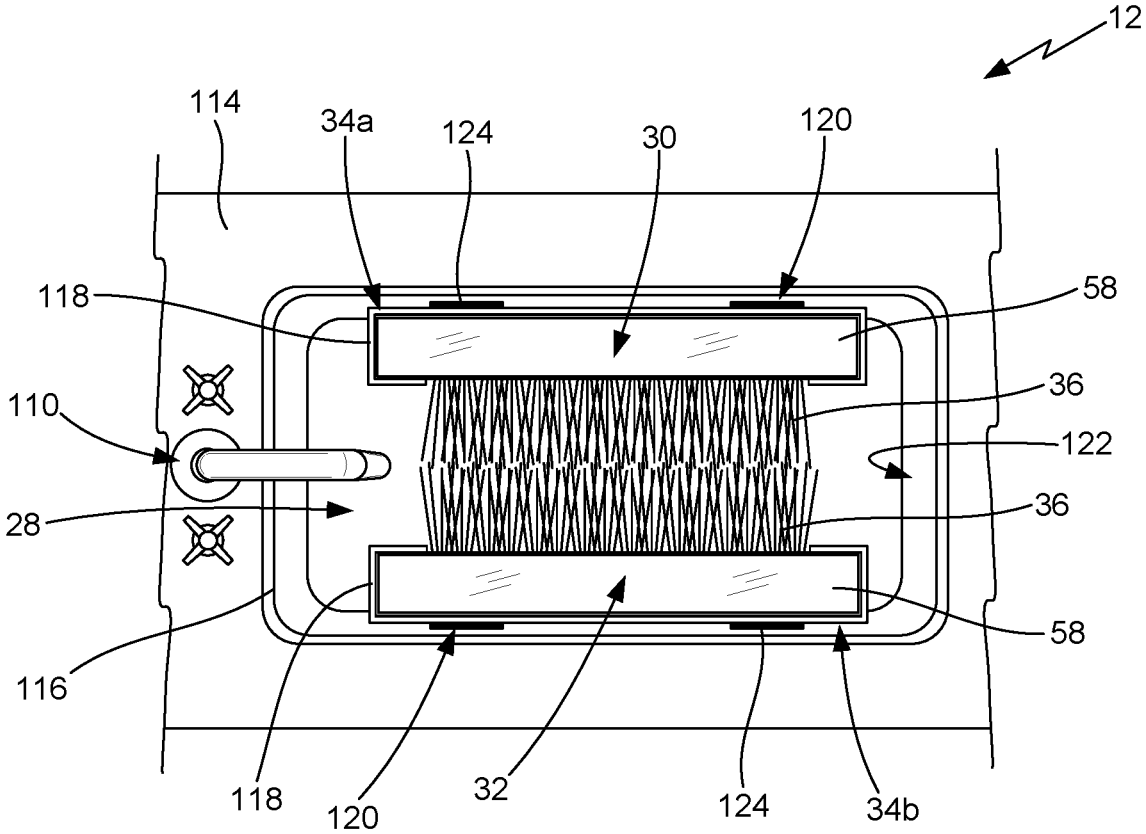
FIG. 13 is a top view of a cleaning apparatus configured according to a third embodiment of the present invention showing the open cleaning area defined by a sink-like opening in a counter.
Figure 14:
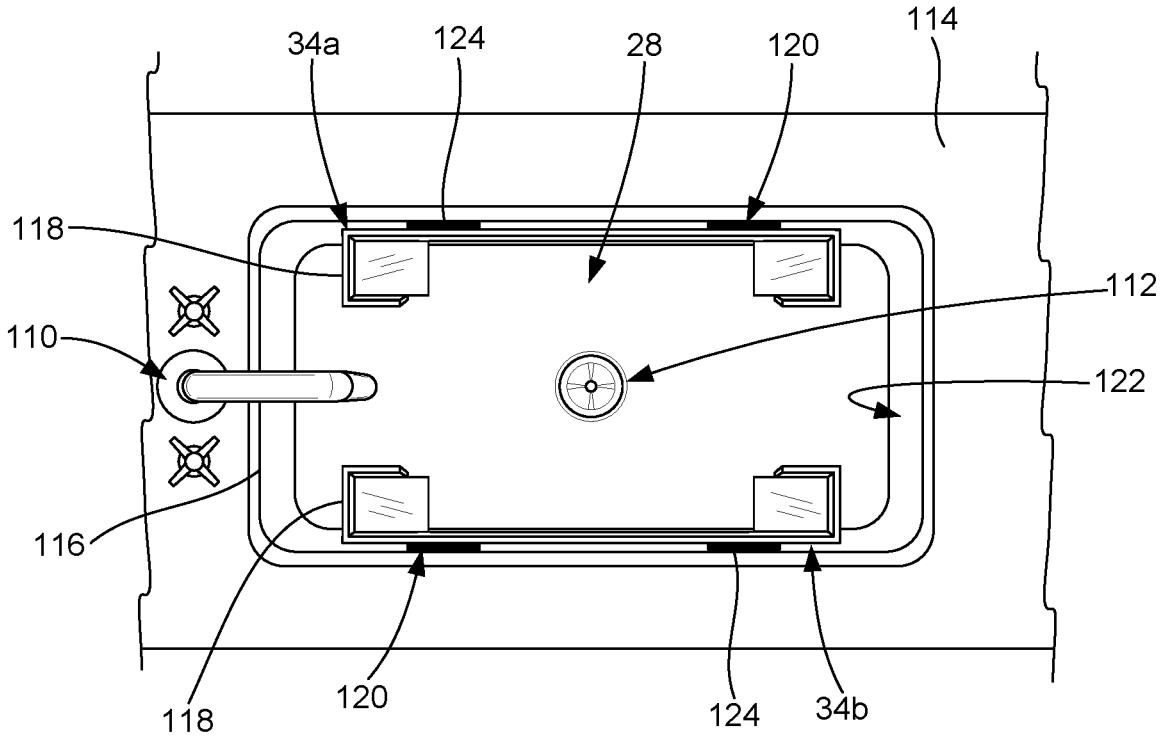
FIG. 14 is a top view of the cleaning apparatus of FIG. 13 shown without the brushes to better illustrate the brush mounting mechanisms.

As will be explained in more detail below, the new cleaning apparatus 10 and system 12 of the present invention is structured and arranged to easily, effectively and efficiently remove food waste 16 from the surfaces 18 of a plate 14 or utensil 15 to substantially reduce the amount of time and resources that would otherwise be required to more fully clean the plate 14 or utensil 15, such as cleaning the plate 14 or utensil 15 in a dish washing machine or by other methods (i.e., by hand in a sink). The new cleaning apparatus 10 and system 12 are particularly useful for quickly, efficiently and effectively pre-cleaning a plate 14 or utensil 15 that has dried food waste 16 on one or more of the surfaces 18 thereof so as to eliminate, or at least substantially eliminate, the need for hand scraping, wiping, spraying, soaking and/or various other pre-cleaning methods of removing food waste 16 from the plate 14 or utensil 15 before the plate 14 or utensil 15 is washed in a dish washing machine or by other plate washing processes. The new cleaning apparatus 10 and system 12 can be utilized as a stand-alone unit, as shown in FIGS. 1-4 and 12, or it may be incorporated into a table, shelf or like component of a dish washing system, as shown in FIGS. 13-14. As will be readily appreciated by persons who are skilled in the art, the new cleaning apparatus 10 and system 12 reduces the cost and time required to pre-clean a plate 14 or utensil 15 prior to placing the plate 14 or utensil 15 in a dish washing machine or the like to fully cleaning the plate 14 or utensil 15, including hand-washing. In the preferred embodiments of the present invention, the new cleaning apparatus 10 and system 12 are easy to use, adaptable to a wide range of different plate widths PW and configurations (i.e., round, square, rectangular shapes and flat or concave upper surface 18) of plates 14 and different types, sizes and shapes of utensils 15 and are relatively inexpensive to manufacture and use.

In one of the preferred embodiments, the cleaning apparatus 10 and system 12 comprises a bucket or other container 26 that defines an open cleaning area 28 in which the liquid 24 is received, a pair of brushes (shown as first brush 30 and second brush 32) and a brush mounting mechanism 34 associated with each brush 30/32 that is sized and configured to mount the brushes 30/32 in the cleaning area 28. Each of the brush mounting mechanisms, shown as first brush mounting mechanism 34*a* and second brush mounting mechanism 34*b* in FIGS. 1-8, 12-16 and 18-19, are configured to mount the respective brushes 30/32 with the outwardly extending bristles 36 of first brush 30 generally facing towards the outwardly extending bristles 36 of second brush 32. In one of the preferred configurations, the bristles 36 of the brushes 30/32 are disposed in overlapping relation. The bristles 36 are positioned so the surfaces 18 of a plate 14 and/or utensil 15 will be substantially cleaned (i.e., most of the food debris 16 removed) when the plate 14 or utensil 15 is pushed, by the user 20, downward through the bristles 36 of the two brushes 30/32, as shown in FIGS. 1 and 19. When the apparatus 10 is configured with a container 26, as shown in FIGS. 1-4, 12, 17 and 19, the apparatus 10 is a stand-alone unit that can be utilized anywhere the user 20 can benefit from the cleaning ability of the apparatus 10. Other than the use of the container 26 to define cleaning area 28, a built-in configuration, such as shown in FIGS. 13-14, is configured the same, with the pair of brushes 30/32 and the brush mounting mechanisms 34*a*/34*b* configured to mount the brushes 30/32 in the cleaning area 28.

Figure 3:
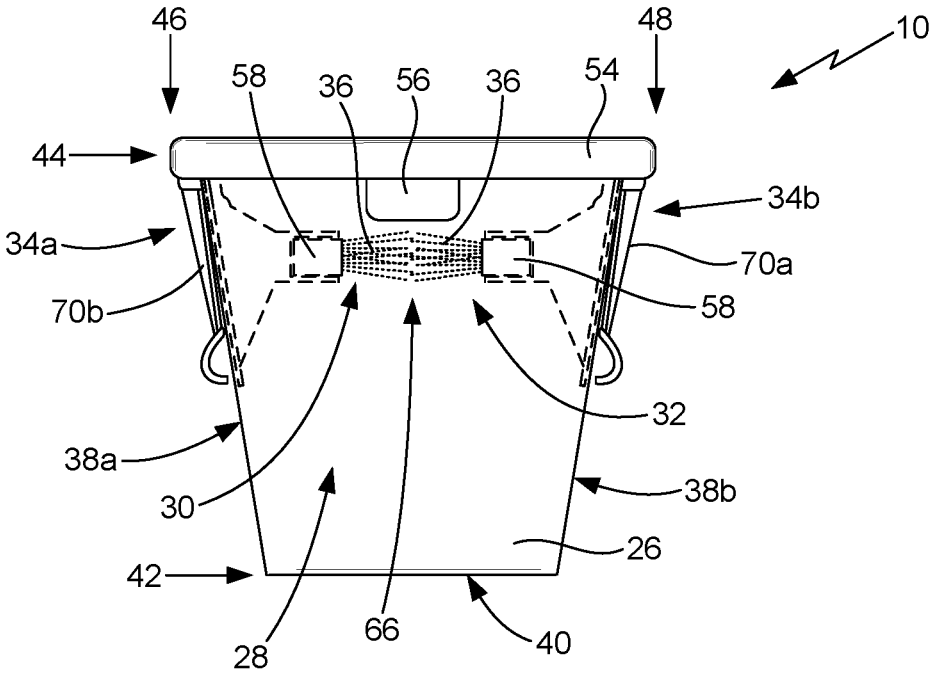
FIG. 3 is an end view of the cleaning apparatus of FIG. 2.

In the stand-alone versions of the apparatus 10 of the present invention, shown in FIGS. 1-4 and 12, the container 26 has one or more sidewalls 38 and a bottom wall 40 that define a closed lower end 42 and an open upper end 44 that opens into the cleaning area 28 in which the liquid 24 and brushes 30/32 are located. In an embodiment with a round or oval cross-section, the container 26 will have a single sidewall 38. In embodiments with a square or rectangular cross-section (as shown in FIGS. 1-4 and 12), the container 26 has a first sidewall 38*a*, second sidewall 38*b*, first end wall 38*c* and a second end wall 38*d* that define a first side 46 and a second side 48, as best shown in FIGS. 1-4. Each of the first 38*a* and second 38*b* sidewalls have an interior sidewall surface 50 and each of the first 38*c* and second 38*d* end walls have an interior end wall surface 52, as shown in the cross-sectional views of FIGS. 5 and 6 with regard to, respectively, the first sidewall 38*a* and first end wall 38*c*. The sidewalls 38 of a typical container 26 defines a peripherally disposed upper edge 54. Most containers 26 will have at least two handles 56 to assist the user 20 with moving the container 26 (i.e., to position it where needed or to empty the liquid from the cleaning area 28), such as the handles 56 shown on the end walls 38*c* and 38*d* (as best shown in FIG. 3 with regard to the first end wall 38*c*). The container 26 can be made out of plastic, rubber, metal, composites and the like that can be sufficiently rigid to support the brushes 30/32, receive the brush mounting mechanism 34, hold the liquid 24 and allow a plate 14 to be inserted in and out of the cleaning area 28 between the brushes 30/32.

The container 26 will have a container height CH between the lower end 42 and the upper end 44, as shown in FIG. 1. Preferably, the container 26 for use with the apparatus 10 and system 12 of the present invention should be sized and configured such that the container 26 can hold liquid 24 with a liquid depth LD that exceeds or is at least substantially equal to the plate width PW and the length of the portion of the utensil 15, such as the knife blade, that can have food debris 16 thereon (shown as utensil length UL in FIG. 19), so the user 20 can fully insert the plate 14 and/or the subject portion of the utensil 15 into the cleaning area 28, between the brushes 30/32, so the entire front and back surfaces 18 of the plate 14 or utensil 15 can be engaged by the brushes 30/32 to remove the food debris 16 therefrom. The container 26 should be selected so the liquid depth LD will exceed the greatest anticipated plate width PW for the plates 14 or utensil length UL for the utensils 15 that will be cleaned by the apparatus 10 and system 12 of the present invention. For those plates 14 where the plate width PW exceeds the liquid depth LD, the user 20 can rotate the plate 14 in his or her hand 22 as he or she moves the plate 14 in and out of between or through the brushes 30/32 to remove food debris 16 from the entire surfaces 18 of the plate 14. If necessary, the user 20 can also push all or a portion of the handle portion of the utensil 15 between or through the brushes 30/32 to also remove food debris 16 from the handle portion.

Figure 4:
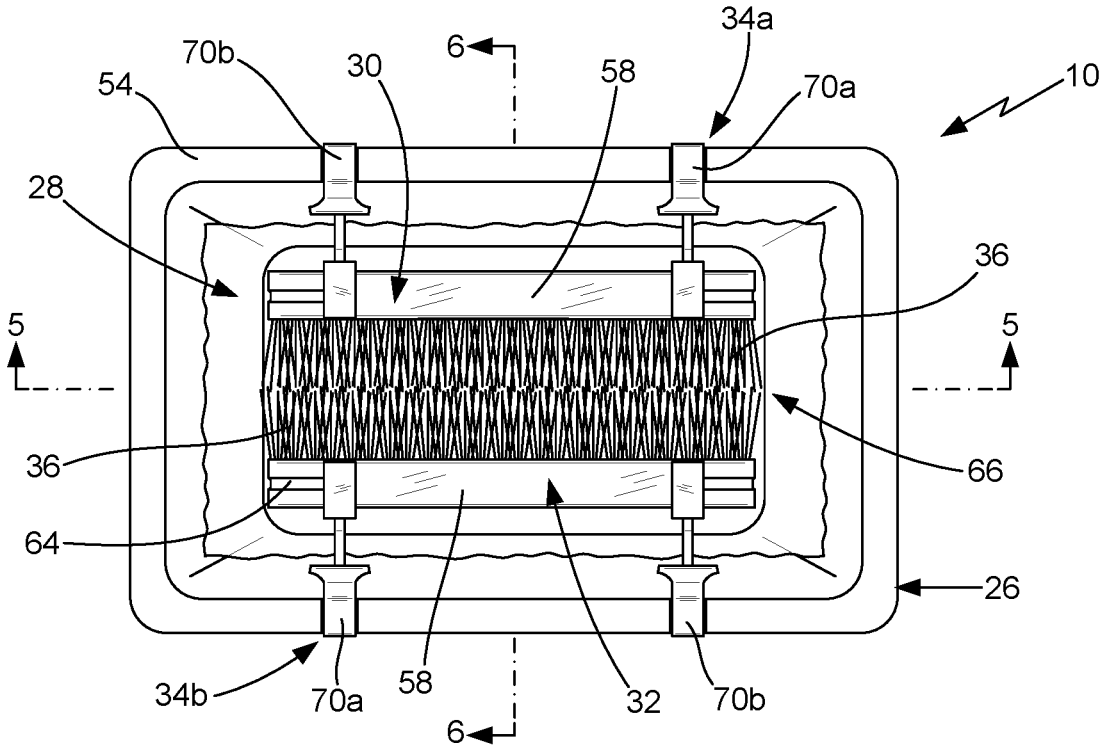
FIG. 4 is a top view of the cleaning apparatus of FIG. 2.
Figure 6:
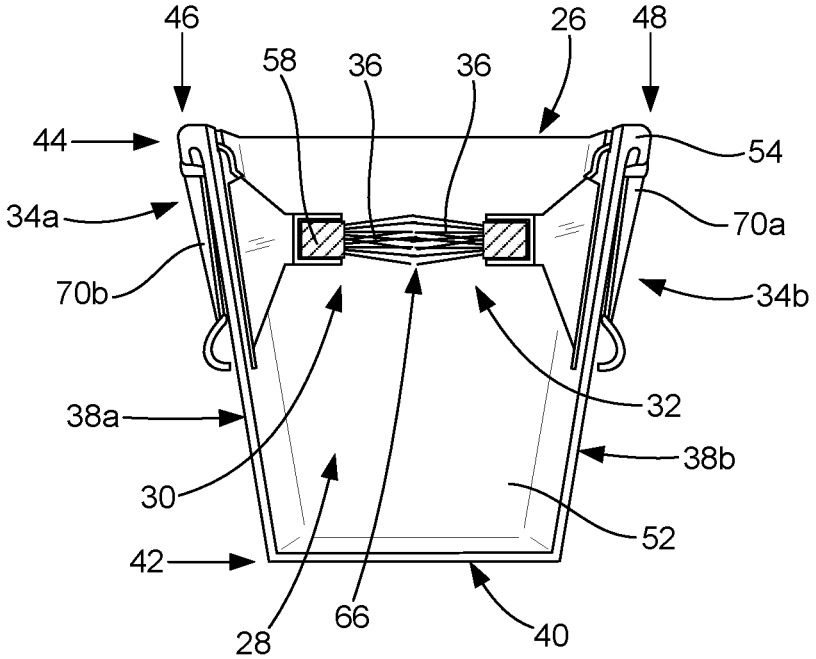
FIG. 6 is a cross-sectional end view of the cleaning apparatus of FIG. 3 taken through lines 6-6 of FIG. 4.
Figure 7:
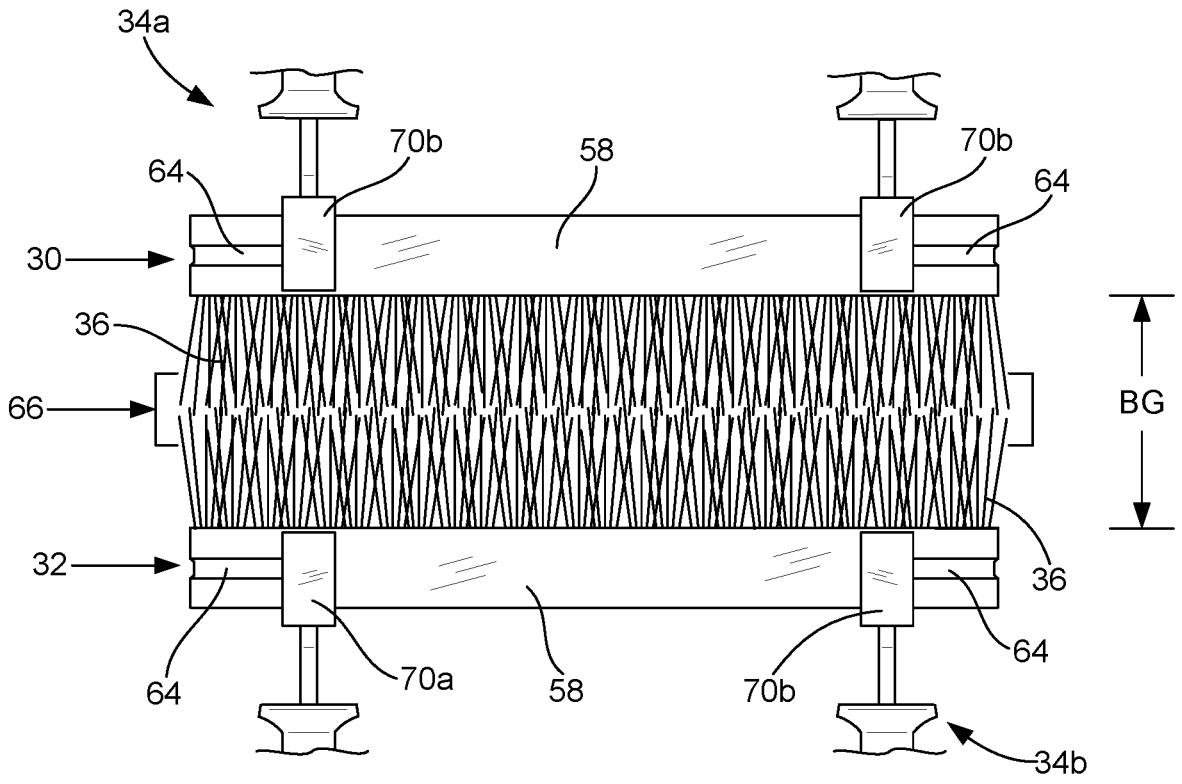
FIG. 7 is a close-up top view of cleaning apparatus of FIG. 4 to better illustrate the engagement of the bristles of the two brushes and the overlap area.
Figure 8:
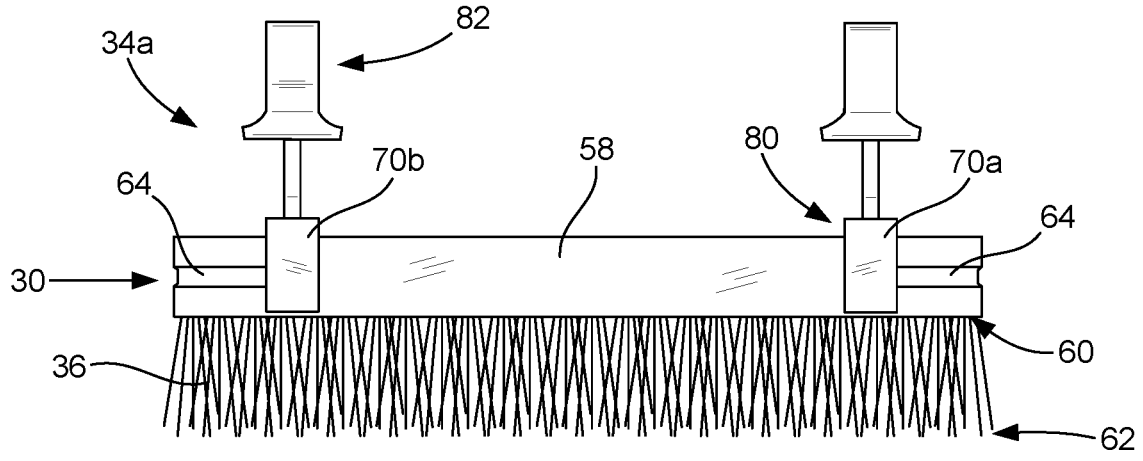
FIG. 8 is a top view of one of the brushes and the brush mounting mechanism of the cleaning apparatus of FIG. 4.
Figure 9:
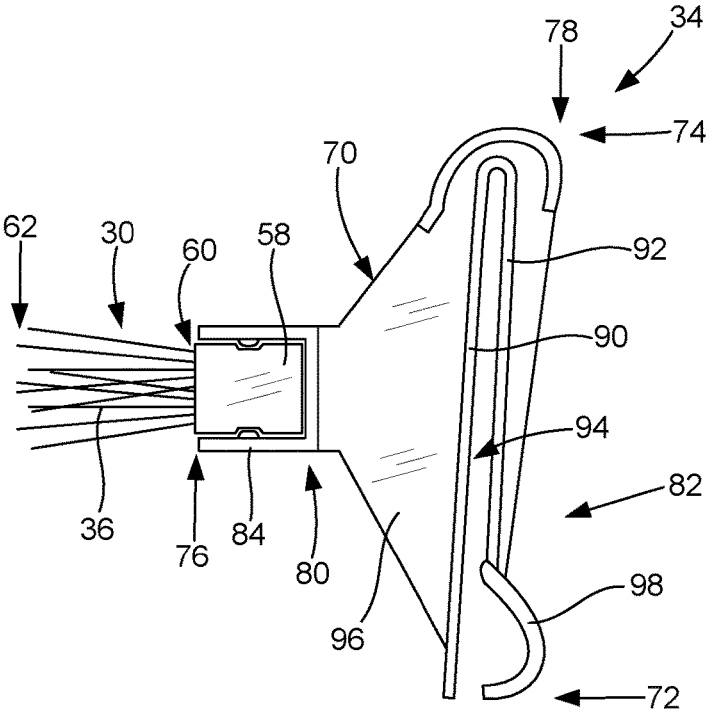
FIG. 9 is an end view of the brush and the brush mounting mechanism of FIG. 8, with the brush mounting mechanism shown as a clip device.
Figure 11:
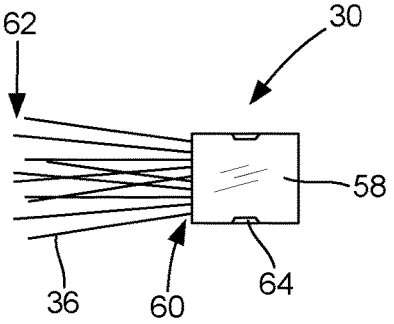
FIG. 11 is an end view of the brush of FIG. 9 shown without the brush mounting mechanism.

The brushes 30/32 utilized with the cleaning apparatus 10 and system 12 of the present invention have a brush body 58 that supports the bristles 36 such that the bristles 36 extend outwardly from the brush body 58, as shown in FIGS. 4-5, 7-9, 11 and 13. The proximal ends 60 of the bristles 36 can be attached to or integrally formed with the brush body 58 so the distal ends 62 of the bristles 36 extend outwardly from the brush body 58, as best shown in FIGS. 8, 9 and 11. In a preferred embodiment, the brush body 58 is specially sized and configured in cooperative relation with the brush mounting mechanism 34 so the brushes 30/32 can be easily received in and removed from the brush mounting mechanism 34 so the user 20 can replace the brushes 30/32 as necessary or desired. As set forth below, the brush mounting mechanisms 34*a*/34*b* also needs to securely support the brushes 30/32 in the respective brush mounting mechanisms 34*a*/34*b* to prevent the brushes 30/32 from being disengaged therefrom during use. In one embodiment, the brush body 58 has slots 64 which are engaged by the brush mounting mechanism 34. As set forth above, the bristles 36 of the first brush 30 extend outward from the brush body 58 thereof towards the bristles of the second brush 32, which extend outward from the brush body 58 of the second brush when the brushes 30/32 are mounted inside the cleaning area 28, as best shown in FIGS. 4 and 6-7.

In one of the preferred configurations of the apparatus 10 and system 12 of the present invention, the container 26, brushes 30/32 and brush mounting mechanisms 34*a*/34*b* are cooperatively configured such that a portion of the bristles 36 of the first brush 30 will overlap a portion of the bristles 36 of the second brush 32 to define an overlap area 66, as best shown in FIGS. 4 and 6-7. To achieve the desired overlap area 66, the container 26, brushes 30/32 and brush mounting mechanisms 34*a*/34*b* should be cooperatively sized and configured to provide a brush gap BG, which is the space between the brush body 58 of the brushes 30/32 (as shown in FIG. 7), that is at least substantially filled with bristles 36. In the preferred configuration, with the overlap area 66, the distal ends 62 (shown in FIGS. 9 and 11) of the distal ends 62 of the bristles 36 of the first brush 30 overlap (i.e., they extend past) the distal ends 62 of the bristles 36 of the second brush 32 so as to be positioned within the bristles 36 of the second brush 32 and the distal ends 62 of the bristles 36 of the second brush 32 extend past the distal ends 62 of the bristles 36 of the first brush 30 so as to be positioned within the bristles 36 of the first brush 30. The inventors have found that use of the overlap area 66 provides better cleaning of the surfaces 18 of the plate 14 or utensil 15 due to the fact that each of the surfaces 18 of the plate 14 or utensil 15 will be fully engaged by the distal ends 62 of the bristles 36 as the bristles 36 bend downward or upward as the plate 14 or utensil 15 is, respectively, pushed through the bristles 36 into the cleaning area 28 or pulled back up through the bristles 36 from the cleaning area 28.

Figure 15:
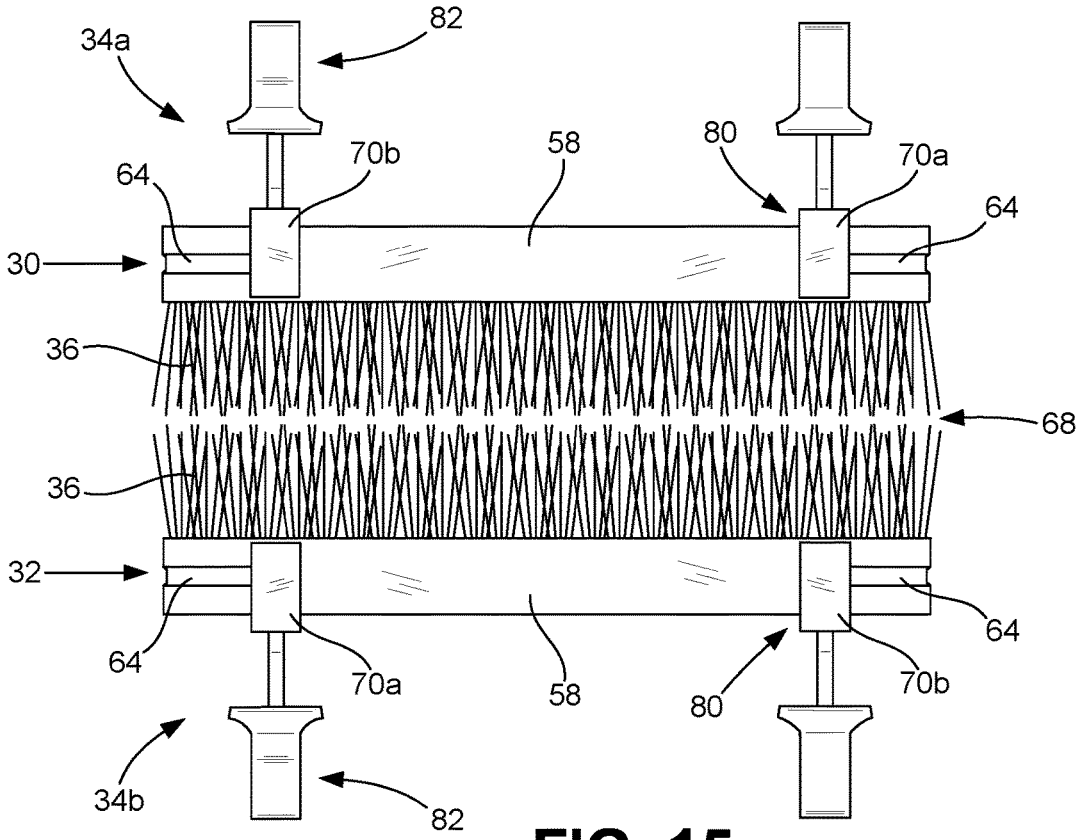
FIG. 15 is a top view of a cleaning apparatus configured according to a fourth embodiment of the present invention showing the bristles of the brushes in non-overlapping relation to define a bristle gap therebetween.
Figure 16:
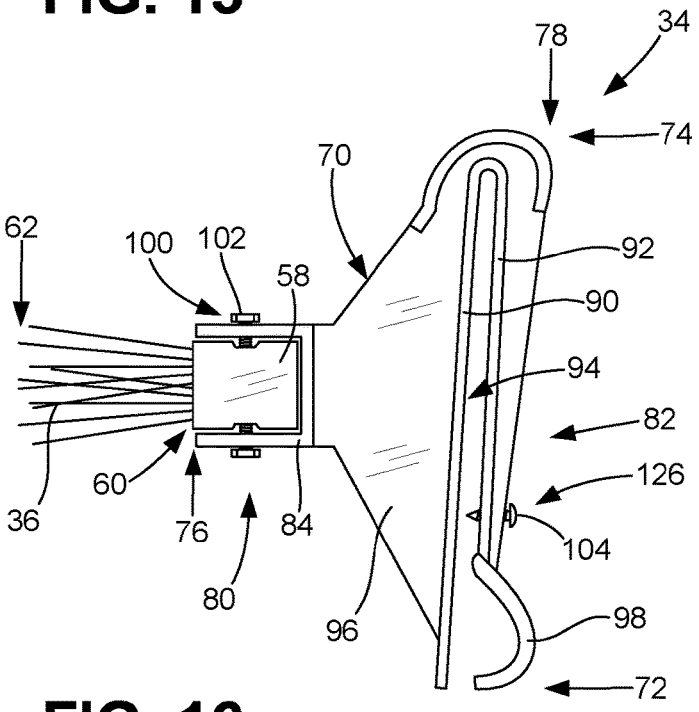
FIG. 16 is an end view of an alternative configuration for the brush mounting mechanism showing use of a clip securing mechanism, which is a screw, to secure the clip device to the container.
Figure 17:
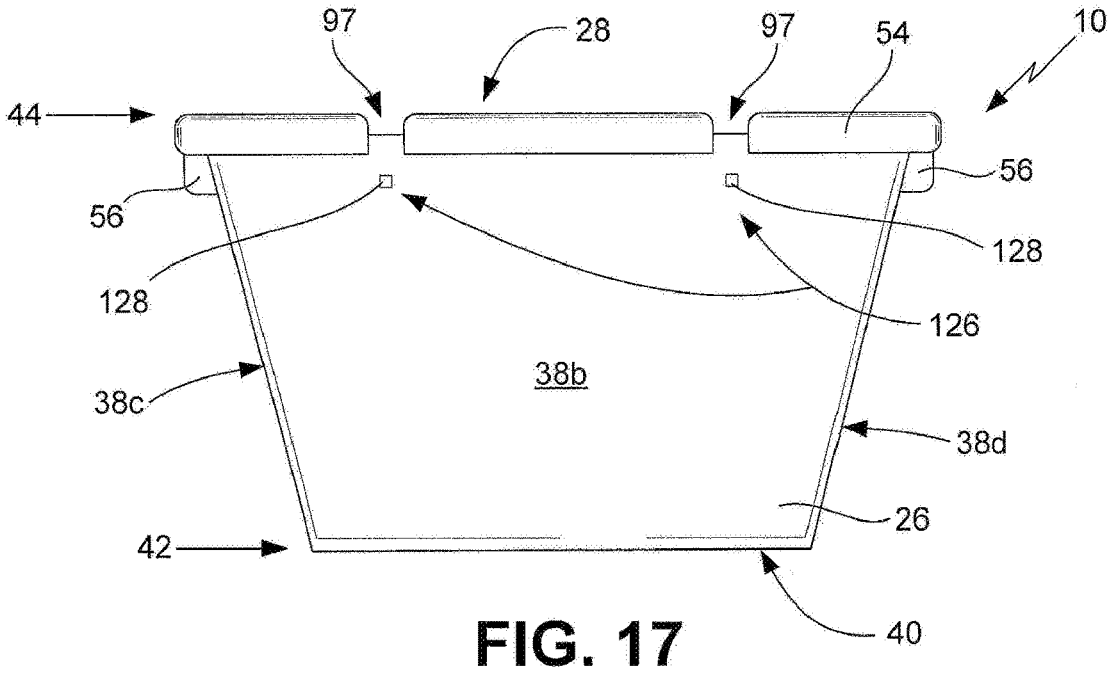
FIG. 17 is a side view of a container that is configured for use with the apparatus and system of the present invention, with the container showing use of notches at the upper end of the sidewall to better mount the clip device to the sidewall of the container and a wall aperture in the sidewall of the container for use as part of a clip securing mechanism to secure the clip device to the container.

In an alternative configuration of the apparatus 10 and system 12 of the present invention, the container 26, brushes 30/32 and brush mounting mechanism 34 can be cooperatively sized and configured such that outwardly extending distal ends 62 of the bristles 36 of the first brush 30 are positioned at or in spaced apart relation to the distal ends 62 of the bristles 36 of the second brush 32 to form a bristle gap 68 between the distal ends 62 of the facing bristles 36 (as shown in FIG. 15). In a configuration with a bristle gap 68, it will be necessary that the bristle gap 68 be relatively slight so that a plate 14 or utensil 15 will not be able to fit through the brushes 30/32 without engaging both the front and back surfaces 18 of the plate 14 or utensil 15 at the same time as the plate 14 or utensil 15 is pushed through the bristle gap 68 into the cleaning area 28.

As set forth above, the brush mounting mechanism 34 is structured and arranged to support the brushes 30/32 in the cleaning area 28 such that any food debris 16 on the surfaces 18 of the plate 14 or utensil 15 will be at least substantially removed when the plate 14 or utensil 15 is pushed into the cleaning area 28, as shown in FIG. 1. In a preferred configuration, the brush mounting mechanisms 34*a*/34*b* provide the overlap area 66 and the plate 14 or utensil 15 is cleaned when the plate 14 or utensil 15 is pushed through the bristles 36 at or near the overlap area 66. In one embodiment, each brush mounting mechanism 34 is structured and arranged to removably support the brushes 30/32 in the cleaning area 28 so the brushes 30/32 can be removed for cleaning, repair and/or replacement. In the embodiment with the container 26, the brush mounting mechanism 34 is also structured and arranged to be removably attached to a sidewall 38 of the container 26 so the brushes 30/32 can be easily removed from the container 26 and the container 26 can be emptied, cleaned or replaced. Alternatively, the brush mounting mechanisms 34*a*/34*b* may be integrally formed with the brushes 30/32 and/or the brush mounting mechanisms 34*a*/34*b* may be integrally formed with the container 26 (i.e., the container 26 and brush mounting mechanism 34 are provided as a single unit). In the embodiment of FIGS. 13-14, with the sink-like opening, the brush mounting mechanism 34 can be removably or fixedly attached to the sidewalls of the opening (as described in more detail below).

Figure 10:
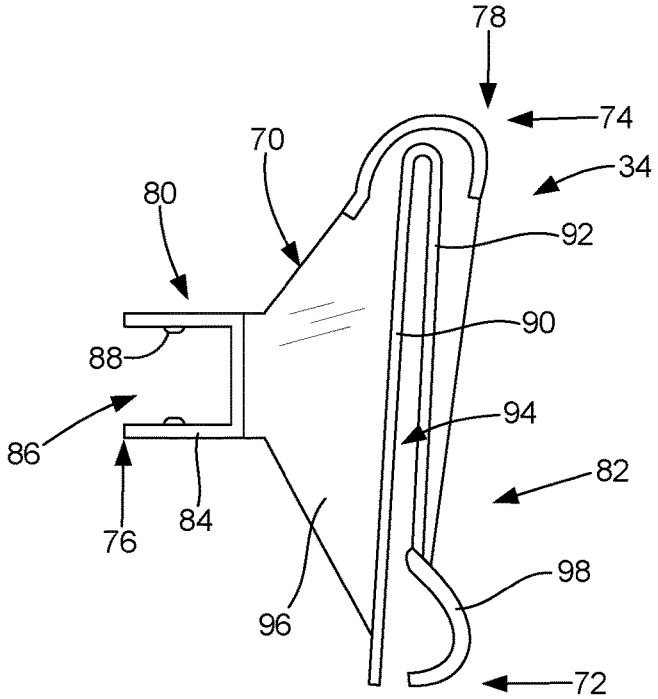
FIG. 10 is an end view of the brush mounting mechanism of FIG. 9 shown without the brush.
Figure 18:
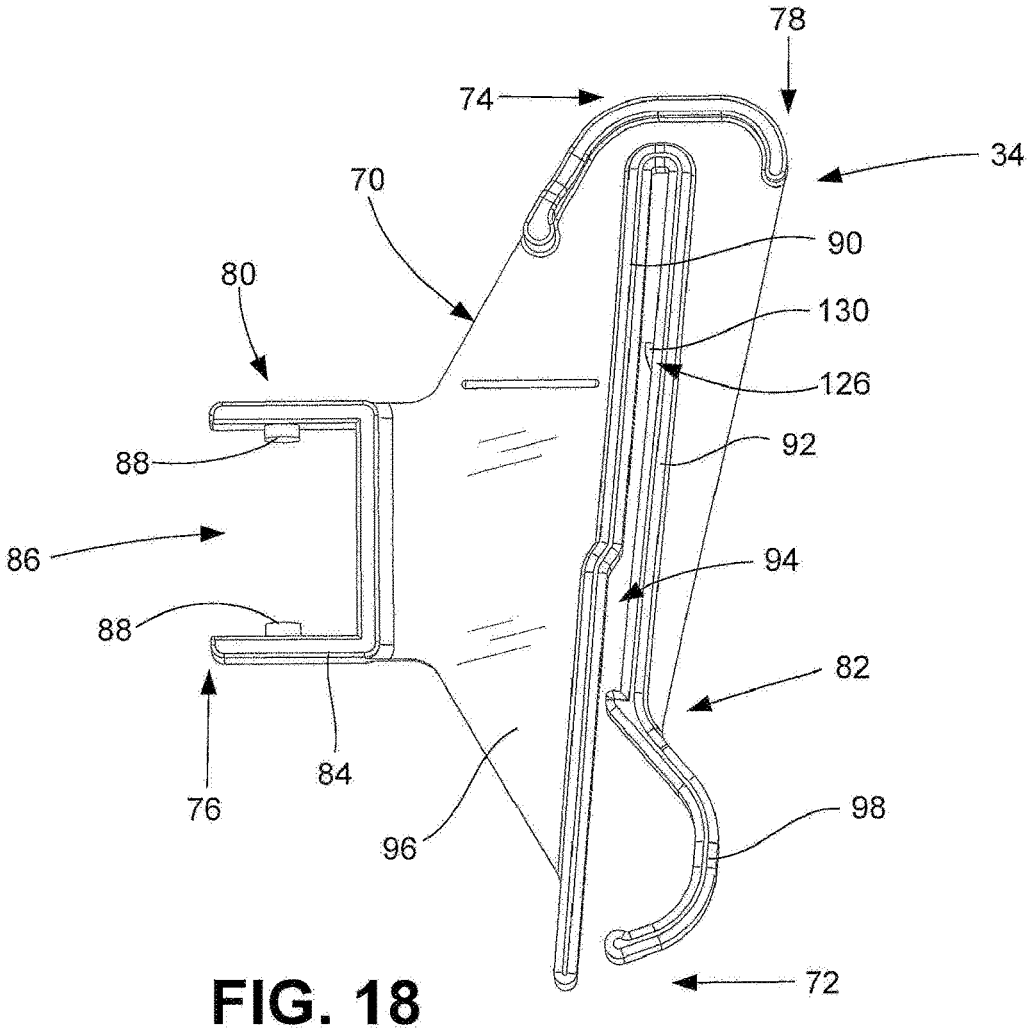
FIG. 18 is an end view of a clip device showing a clip protrusion extending into the wall engaging area of the clip device, with the clip protrusion being sized and configured to be received in the wall aperture of FIG. 17 to secure the clip device to the container.

In the embodiments of the apparatus 10 and system 12 shown in FIGS. 1-12 and 17-19, the brush mounting mechanism 34 comprises one or more clip devices 70 for each brush 30/32, such as the first clip device 70*a* and second clip device 70*b* shown attached to the container 26 in FIGS. 1-7 and 12. As best shown in FIGS. 9-10 and 18, the clip device 70 has a lower end 72, an upper end 74, a front end 76 and a back end 78. For purposes of describing the components, including the clip device 70, of the present invention, the terms "front", "forward", "forwardly" and the like are used to refer to that portion of the clip device 70 that is in or faces at least generally toward the cleaning area 28, where the brushes 30/32 are positioned, when the clip device 70 is in use to support the brushes 30/32. Likewise, the terms "back", "rearward" and "rearwardly" are used to refer to that portion of the clip device 70 that is at or faces at least generally toward the sidewall 38 of the container 26 when the clip device 70 is in use to support the brushes 30/32 in the cleaning area 28. The terms "upper" and "lower", as well as like terms, are utilized to refer to a position, respectively, relative to the upper end 42 of the container 26 or the opening into the cleaning area 28 and lower end 42 and/or bottom wall 40 of the container 26 or the sink-like opening of FIGS. 13-14.

The clip device 70 is structured and arranged to define a brush engaging section 80 generally at or towards the front end 76 of the clip device 70 and a container engaging section 82 generally at or towards the back end 78 of the clip device 70, as best shown in FIGS. 9-10 and 18. The brush engaging section 80 is sized and configured to engage and support one of the brushes 30/32 in a manner which disposes each brush 30/32 in the cleaning area 28 in a manner that disposes the bristles 36 of one brush 30/32 in opposing, preferably overlapping, relation to the bristles 36 of the other brush 30/32. The container engaging section 82 is sized and configured to engage the container 26 and position the brush engaging section 80 where the brushes 30/32 can accomplish the various objectives of the present invention. In a preferred embodiment, the brush engaging section 80 and the container engaging section 82 are integrally formed, such that the clip device 70 is a single unitary device. In one configuration, the entire clip device 70 is molded from plastic or like materials. In various other embodiments, the clip device 70 may be made out of a wide variety of materials and can be configured such that the brush engaging section 80 and the container engaging section 82 are attached together to form the clip device 70.

In the preferred embodiments, the two engaging sections 80/82 of the clip device 70 are sized and configured in cooperative relation with, respectively, the brushes 30/32 and the container 26 so that the brushes 30/32 will be securely held in the proper position inside the cleaning area 28 for cleaning the surfaces 18 of a plate 14 as the user 20 presses the plate 14 through the bristles 36 in the overlap area 66 (in the preferred configuration). In the embodiment shown in the figures, the brush engaging section 80 comprises a generally U-shaped bracket 84 that defines a brush-receiving area 86, as best shown in FIGS. 9-10 and 18, in which the brush body 58 of a brush 30/32 is engagedly received. In one embodiment, the brush-receiving area 86 can be sized and configured to tightly engage the brush body 58 to hold the brush 30/32 in place. For instance, in one embodiment the U-shaped bracket 84 can be sized and configured so the brush body 58 will securely snap into the bracket 84 (e.g., the outward walls of the bracket 84 flex outwardly to receive the brush body 58 and then close around the brush body 58). In the embodiment of the clip device 70 shown in FIGS. 9-10 and 18, the U-shaped bracket 84 has a pair of opposing slot engaging protrusions 88 that are generally positioned on opposite facing sides of the interior walls of the brush-receiving area 86 and structured and arranged to slidably engage the slots 64 on opposite sides of the brush body 58 to help secure the brush 30/32 to the clip device 70. The slot 64 of the brush body 58 and the slot engaging protrusions 88 are cooperatively sized and configured to allow the user 20 to slide the brush 30/32 onto the bracket 84 of the clip device 70 before the clip device 70 is positioned on the container 26. As will be readily appreciated by persons who are skilled in the relevant art, the brush engaging section 80 and the portion of the brushes 30/32 which the clip device 70 engages can be configured in a wide variety of different manners to accomplish the various objectives of the apparatus 10 and system 12 of the present invention.

Figure 5:
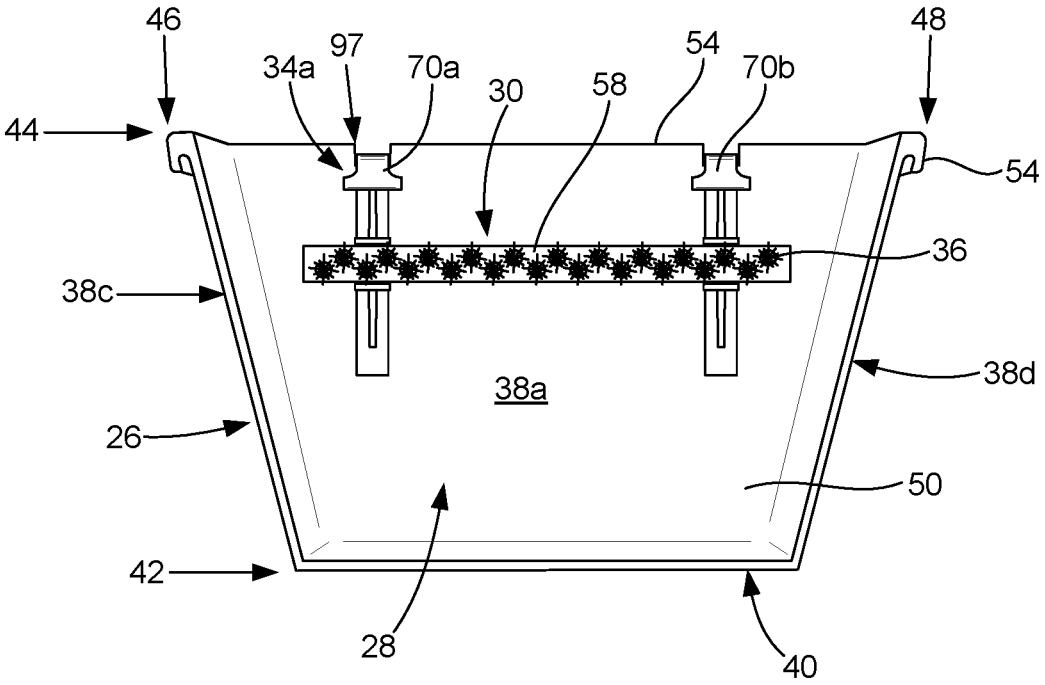
FIG. 5 is a cross-sectional side view of the cleaning apparatus of FIG. 2 taken through lines 5-5 of FIG. 4.

The container engaging section 82 of the clip device 70 is specially structured and arranged to engage and attach to the container 26 to position the brushes 30/32 inside the cleaning area 28 in opposing relation to each other, as shown in FIGS. 3-7. In a preferred configuration, the container engaging section 82 is configured to removably engage a sidewall 38 of the container 26. In other embodiments, the container engaging section 82 can be configured to be integrally formed with the container 26 and/or configured to engage other components of the container 26. In the embodiment shown in the figures, the container engaging section 82 comprises a first clip member 90 that is integrally formed with a second clip member 92 to define a wall engaging area 94 located between the two spaced apart clip members 90/92, as shown in FIGS. 9-10. As also shown, attached to the first clip member 90 is a connecting member 96 interconnecting the container engaging section 82 and the bracket 84 of the brush engaging section 80. As shown in FIGS. 1-6, the container engaging section 82 is configured such that the first clip member 90 and the second clip member 92 will be positioned over opposite facing sides of one of the sidewalls 38 with the subject sidewall 38 being positioned in the wall engaging area 94 of the container engaging section 82 such that the upper end 74 of the clip device 70 is received in a notch 97 at the upper peripheral edge 54 of the container 26, as shown in FIGS. 1 and 5. Preferably, each component of the container engaging section 82 is sized and configured to tightly engage the sidewall 38 when the user 20 presses the clip device 70 downward on the sidewall 38 to securely hold the clip device 70 in place so that the brushes 30/32 will not move upward or downward in the cleaning area 28 during use of the new dish cleaning apparatus 10 and system 12. The notch 97 in the container 26 helps hold the clip device 70 in position on the respective sidewalls 38 of the container 26 on which the clip device 70 is mounted. The embodiment shown in the figures has an outwardly curved section 98 at or near the lower end 72 of the clip member 70 that is sized and configured to assist with the second clip member 92 bending outward when the clip member 70 is being placed over the sidewall 38 of the container 26 and then holding the clip member 70 tightly on the subject sidewall 38.

As will be readily appreciated by persons who are skilled in the art, the configuration of the clip member 70 described above is only one of many ways of configuring the clip member 70. Specifically, when utilized with a container 26, the clip member 70 only needs to be structured and arranged with a brush engaging section 80 that holds the brushes 30/32, preferably securely, in position so the bristles 36 of one brush 30/32 will face, at least substantially, toward the bristles 36 of the other brush 30/32 and the container engaging section 82 will hold the clip member 70, preferably securely, in place on the sidewall 38 of the container 26 in order to position and maintain the position of the brushes 30/32 as described above. Persons who are skilled in the art will also readily appreciate that the brush engaging section 80 can have one or more clamping mechanisms 100, such as the bolt 102 shown in FIG. 16, that can be selectively engaged by the user 20 to hold the brushes 30/32 (i.e., typically the brush body 58) in the brush engaging section 80 of the clip device 70. Persons who are skilled in the art will also appreciate that container engaging section 82 can have one or more wall securing mechanisms 126, such as the screw 104 shown in FIG. 16, that can be selectively engaged by the user 20 to securely hold the clip device 70 on the sidewall 38 of the container 26. The clamping mechanism 100 for the brushes 30/32 and the clip securing mechanism for the container 26 can comprise one or more screws, bolts, spring-driven clamps and the like. One of the preferred configurations for clip securing mechanism 126 comprises a wall aperture 128 (shown in FIG. 17) disposed in the sidewall 38 of the container 26 and a corresponding clip protrusion 130 (shown in FIG. 18) that is integral with, attached to or otherwise associated with the one or both of the clip members 90/92 of the clip device 70 so as to extend into the wall engaging area 94 so as to engage the wall aperture 128 when the clip device 70 is positioned on a sidewall 38 of the container 26. In this embodiment, when the clip device 70 is placed on the sidewall 38 of the container 26 the clip protrusion 130 will move into and securely engage the wall aperture 128 of the sidewall 38 to hold the clip device 70 on the container 26. The wall aperture 128 and clip protrusion 130 should be cooperatively configured so the clip protrusion 130 will fit inside the wall aperture 128 in a manner which secures the clip device 70 to the container 38 until the user 20 pulls one of the clip members 90/92 away from the sidewall 38 to pull the clip protrusion 130 out of the wall aperture 128 so the user 20 can then slide or pull the clip device 70 upward relative to the sidewall 38 to remove the clip device 70 from the container 26. One configuration of the clip protrusion 130 that has been found to work well comprises a horizontal top surface and an angled front surface, as shown in FIG. 18. The use and configuration of clamping mechanisms 100 and clip securing mechanisms 126 that are or can be structured and arranged to securely, but removably, engage objects such, respectively, as the brush body 58 or container wall 38 are well known in the art. In addition, the clip device 70 can be configured to be fixedly attached to or even integral with one or more of the brushes 30/32 and/or the sidewall 38 of the container 26.

In the embodiments set forth above, the container 26 is of the bucket or like type container has solid sidewalls 38 and bottom wall 40 that define the cleaning area 28 which has water or other liquid 24 that is placed in the container 26 through the open upper end 44. When the liquid 24 needs to be replaced, the user 20 will (typically) remove the brushes 30/32, often by removing the brush mounting mechanism 34 (i.e., clip device 70) from the container 26, and then lifting the container 26 upward to dump the dirty liquid 24 out of the container 26. The embodiment of FIG. 12 illustrates the use of an inlet 106 at or near the upper end 44 of the container 26 and an outlet 108 at or near the lower end 42 of the container 26 for placing liquid 24 into the container 26 and draining liquid 24 from the container 26. The embodiment shown in FIG. 12 allows the user to easily connect a tube or hose to the inlet 106 to place liquid 24 in the container 26 (i.e., to a level at or, preferably, above the brushes 30/32) for use to clean plates 14 or utensils 15 and eliminates the need to raise or otherwise lift the container 26 to drain the dirty liquid 24 from the container 26. By connecting a liquid source 110, such as the faucet of FIGS. 13 and 14 (via a hose, tube or etc.), to the inlet 106 to place liquid 24 into the container 26 and connecting a drain 112, such as also shown in FIG. 14, to the outlet 108, the user 20 can easily add and remove liquid 24 from the container 26. The inlet 106 can be positioned through a sidewall 38 at or below the upper peripheral edge 54 of the container 26, as shown in FIG. 12, or it can be configured to be positioned above the upper peripheral edge 54 of the container 26, thereby eliminating the need to place the inlet 106 through a sidewall 38. The outlet 108 can be placed through the sidewall 38 generally towards the lower end 42 of the container 26, as shown in FIG. 12, or it can be placed in the bottom wall 40. The configuration and use of inlets 106 and outlets 108 for containers 26 are generally well known in the art.

The embodiment of FIGS. 13 and 14 show the use of the apparatus 10 and system 12 of the present invention incorporated into a counter, shelf or other work surface 114 having a surface opening 116, such as a sink or the like, such as the type that are utilized with commercial dishwashing machines (not shown) to prepare plates 14 or utensils 15 for placement into the dishwashing machine. The surface opening 116 in the work surface 114 defines the cleaning area 28 where the brushes 30/32 are placed with the bristles 36 in generally facing relation, with the overlap area 66 (as shown in FIG. 13) or with the bristle gap 68 set forth above. In one embodiment, the work surface 114 can be provided with slots or other apertures substantially adjacent the opening 116 that are sized and configured to receive the clip device 70 described above. However, as will be readily appreciated by persons who are skilled in the art, for use of apparatus 10 with the work surface 114 and opening 116, the brush mounting mechanisms 34*a*/34*b* will generally have to be adapted for using the apparatus 10 inside the opening 116 in the work surface 114.

In the embodiment shown in FIGS. 13-14, each of the brush mounting mechanisms 34*a*/34*b* comprises a pair of brush brackets 118 that are sized and configured to receive and support the brushes 30/32 and an attaching mechanism 120 that attaches the brush brackets 118 to the interior surface 122 of the opening 116. The brush brackets 118 can be structured and arranged for the user 20 to place the brush body 58 in the U-shaped portions of the brush brackets 118 and to engage the brush body 58 in a manner that securely holds the brushes 30/32 in the brush brackets 118. A variety of bracket configurations and/or locking devices can be used to secure the brushes 30/32 in the brush brackets 118, such as being tight fitting and/or have engaging devices that lock the brushes 30/32 to their respective brush brackets 118. Such configurations and devices are generally well known to persons skilled in the relevant arts. The attaching mechanism 120 needs to be selected to securely hold the brush brackets 118 and brushes 30/32 to the interior surface 122 of the opening 116 so they will remain in position in the cleaning area 28 when using the apparatus 10 and system 12 to clean plates 14 and utensils 15. FIGS. 13 and 14 show the use of strong magnets 124 as the attaching mechanism 120, with the magnets 124 attached to or integral with the brush brackets 118 and selected to magnetically engage the interior surface 122 of the opening 116. As will be readily appreciated by persons who are skilled in the art, a variety of other devices may be utilized as the attaching mechanism 120. Such devices may be, depending on the interior surface 122, adhesives, bolts, screws, rivets and various other types of connecting devices that are or can be configured to secure the brush brackets 118 to the interior surface 122 of the opening 116.

As set forth above, the system 12 of the present invention comprises a plate 14 or utensil 15 having one or more surfaces 18 that are to be cleaned, food or other debris 16 on one or more of the surfaces 18 that is to be removed from the plate 14 or utensil 15, the user 20 who holds the plate 14 or utensil 15 in his or her hand 22, the apparatus 10 comprising a container 26 or opening 116 that defines a cleaning area 28, and the water or other liquid 24 in the cleaning area 28, as shown in FIGS. 1 and 13. The apparatus 10 used with the system 12 also includes a first brush 30, a second brush 32 and a brush mounting mechanism 34 that is associated with each brush 30/32 (i.e., brush mounting mechanisms 34*a*/34*b*) that securely hold the brushes 30/32 in the cleaning area 28, defined by the container 26 or opening 116, in a manner that disposes the bristles 36 of the two brushes 30/32 in opposing, facing relation to each other, as shown in FIGS. 3-4, 6-7, 13 and 15. The brushes 30/32 and brush mounting mechanisms 34*a*/34*b* can be configured as described above, namely with the cooperatively configured brush body 58 and brush mounting mechanism 34, or these components may be configured in a variety of other similar manners.

In use, the apparatus 10 and system 12 will typically be in an area where plates 14 and/or utensils 15 will undergo additional cleaning, such as in a dishwashing machine or sink, so the user can utilized the new apparatus 10 and system 12 to more easily, effectively and efficiently remove the debris 16 from the surfaces 18 of the plate 14 or utensil 15. The user 20 inserts the plate 14 or utensil 15 into cleaning area 28 of the apparatus 10 between the two brushes 30/32, either at the overlap area 66 or through the bristle gap 66, so the bristles 36 of the brushes 30/32 will engage the surfaces 18 and remove the debris 16 from the plate 14 or utensil 15. The bristles 36 will also remove debris 16 from the surfaces 18 as the user pulls the plate 14 or utensil 15 back out of apparatus 10. It is anticipated that a single pass through the apparatus 10 will be sufficient to remove virtually all debris 16 from the surfaces 18 of a plate 14 or utensil 15, particularly when using overlap area 66. When necessary or desired, the user 20 can remove the liquid 24 from the container 26 and replace it with fresh liquid 24. In addition, when necessary or desired, the user 20 may remove the brushes 30/32, with or without removing the brush mounting mechanism 34, from the cleaning area 28 to clean, repair or replace the brushes 30/32 (i.e., if the bristles 36 thereof become worn or damaged).

The stand-alone version of the new apparatus 10 and system 12 of the present invention, having a container 26, can be utilized virtually anywhere. The built-in version of the new apparatus 10 and system 12, with the opening 116 in the work surface 114, will typically be utilized in commercial settings. If desired, the apparatus 10 and system 12 of the present invention can be utilized with the brushes 30/32 being vertically disposed, whether in a container 26 or opening 116, above a work surface 114 or other area so that the apparatus 10 does not utilized limited floor space or for other beneficial reasons (i.e., more convenient and easier for the user 20). Other configurations for the new apparatus 10 and system 12 are also likely to be possible.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A cleaning apparatus for removing debris from one or more surfaces of a plate or a utensil, said cleaning apparatus comprising:

a cleaning area defined by a container having at least a first sidewall and a second sidewall, said second sidewall positioned in opposing relation to said first sidewall, each of said first sidewall and said second sidewall of said container having a notch at an upper peripheral edge thereof;

a first brush disposed in said cleaning area, said first brush having a plurality of outwardly extending bristles;

a second brush disposed in said cleaning area, said second brush having a plurality of outwardly extending bristles;

a first clip device associated with said first brush to secure said first brush to said first sidewall of said container; and a second clip device associated with said second brush to secure said second brush to said second sidewall of said container, each of said first clip device and said second clip device has a brush engaging section and a container engaging section, said brush engaging section of said first clip device sized and configured to engage said first brush, said brush engaging section of said second clip device sized and configured to engage said second brush, said container engaging section of said first clip device sized and configured to be received in said notch of said first sidewall and said container engaging section of said second clip device sized and configured to be received in said notch of said second sidewall so as to secure each of said first clip device and said second clip device to said container, said container engaging section of each of said first clip device and said second clip device has a first clip member and a second clip member defining a wall engaging area therebetween, said wall engaging area of said first clip device sized and configured to receive said first sidewall therein so as to further secure said first clip device to said container with said first brush disposed in said cleaning area of said container, said wall engaging area of said second clip device sized and configured to receive said second sidewall therein so as to further secure said second clip device to said container with said second brush disposed in said cleaning area of said container with each of said first brush and said second brush cooperatively mounted in said cleaning area so as to dispose said bristles of said first brush generally toward said bristles of said second brush such that when a user pushes one of the plate and the utensil through said bristles of said first brush and said bristles of said second brush said bristles of at least one of said first brush and said second brush will remove the debris from the surfaces of the plate or utensil.

2. The cleaning apparatus of claim 1, wherein each of said first clip device and said second clip device is structured and arranged to tightly attach said first clip device to said first sidewall of said container and said second clip device to said second sidewall of said container.

3. The cleaning apparatus of claim 2, wherein each of said first clip device and said second clip device comprises an outwardly curved section that is sized and configured to assist with attaching said first clip device to said first sidewall and said second clip device to said second sidewall and with removing said first slip device from said first sidewall and said second clip device from said second sidewall.

4. The cleaning apparatus of claim 2 further comprising a securing mechanism associated with at least one of said first clip device and said second clip device, said securing mechanism being structured and arranged to securely attach said at least one of said first clip device and said second clip device to said container.

5. The cleaning apparatus of claim 4, wherein said securing mechanism comprises a wall aperture in at least one of said first sidewall and said second sidewall of said container and a clip protrusion on one of said first clip member and said second clip member of at least one of said first clip device and said second clip device, said clip protrusion positioned so as to extend into said wall engaging area between said first clip member and said second clip member, said clip protrusion sized and configured to be received in said wall aperture so as to securely attach said first clip device or said second clip device to said at least one of said first sidewall and said second sidewall of said container.

6. The cleaning apparatus of claim 5, wherein each of said first clip device and said second clip device comprises an outwardly curved section that is sized and configured to assist with attaching said first clip device to said first sidewall and said second clip device to said second sidewall and with removing said first clip device from said first sidewall and said second clip device from said second sidewall.

7. The cleaning apparatus of claim 1, wherein said brush engaging section of each of said first clip device and said second clip device is structured and arranged to engage a brush body of one of said first brush and said second brush, said bristles of each of said first brush and said second brush having a proximal end at said brush body and a distal end extending outwardly from said brush body.

8. The cleaning apparatus of claim 7, wherein said brush engaging section of each of said first clip device and said second clip device comprises a U-shaped bracket defining a brush receiving area sized and configured to receive and engage said brush body of said one of said first brush and said second brush to support said one of said first brush and said second brush in said cleaning area, wherein said brush body of each of said first brush and said second brush has a slot that is securely engaged by one or more slot engaging protrusions extending into said brush receiving area of each of said brackets to secure said first brush onto said first clip device and said second brush onto said second clip device.

9. The cleaning apparatus of claim 7, wherein each of said first clip device and said second clip device is cooperatively configured with each of said first brush and said second brush so as to define an overlap area wherein said distal end of said bristles of said first brush are disposed in said bristles of said second brush and said distal end of said bristles of said second brush are disposed in said bristles of said first brush when each of said first brush and said second brush are disposed in said cleaning area.

10. The cleaning apparatus of claim 7, wherein each of said first clip device and said second clip device is cooperatively configured with each of said first brush and said second brush so as to define a bristle opening wherein said distal end of said bristles of said first brush are disposed in spaced apart relation to said distal end of said bristles of said second brush when each of said first brush and said second brush is disposed in said cleaning area.

11. The cleaning apparatus of claim 1, wherein said bristles of each of said first brush and said second brush have a distal end extending into said cleaning area, each of said first brush and said second brush being cooperatively configured with each of said clip devices so as to define an overlap area wherein said distal end of said bristles of said first brush are disposed in said bristles of said second brush and said distal end of said bristles of said second brush are disposed in said bristles of said first brush when each of said first brush and said second brush are disposed in said cleaning area.

12. A cleaning apparatus for removing debris from one or more surfaces of a plate or a utensil, said cleaning apparatus comprising:

a cleaning area defined by a container having at least a first sidewall and a second sidewall, said second sidewall positioned in opposing relation to said first sidewall, each of said first sidewall and said second sidewall of said container has a notch at an upper peripheral edge thereof;

a first brush having a brush body with a plurality of outwardly extending bristles, each of said bristles having a proximal end at said brush body and a distal end extending outwardly from said brush body;

a second brush having a brush body with a plurality of outwardly extending bristles, each of said bristles having a proximal end at said brush body and a distal end extending outwardly from said brush body;

a first clip device associated with said first brush for removably mounting said first brush in said cleaning area;

a second clip device associated with said second brush for removably mounting said second brush in said cleaning area, each of said first clip device and said second clip device having a brush engaging section and a container engaging section, said brush engaging section of said first clip device sized and configured to engage said first brush, said brush engaging section of said second clip device sized and configured to engage said second brush, said container engaging section of said first clip device sized and configured to be received in said notch of said first sidewall and said container engaging section of said second clip device sized and configured to be received in said notch of said second sidewall so as to secure each of said first clip device and said second clip device to said container, said container engaging section of each of said first clip device and said second clip device having a first clip member and a second clip member defining a wall engaging area therebetween, said wall engaging area of said first clip device sized and configured to receive said first sidewall therein so as to further secure said first clip device to said container with said first brush disposed in said cleaning area of said container, said wall engaging area of said second clip device sized and configured to receive said second sidewall therein so as to further secure said second clip device to said container with said second brush disposed in said cleaning area of said container, each of said first clip device and said second clip device being cooperatively structured and arranged to dispose said bristles of said first brush generally toward said bristles of said second brush when each of said first brush and said second brush are placed in said cleaning area such that when a user pushes one of the plate and the utensil through said bristles of said first brush and said second brush said bristles of at least one of said first brush and said second brush will remove the debris from the surfaces of the plate;

a securing mechanism associated with said first clip device, said securing mechanism structured and arranged to securely attach said first clip device to said container with an upper end of said first clip device engaging an upper peripheral edge of said container; and a securing mechanism associated with said second clip device, said securing mechanism structured and arranged to securely attach said second clip device to said container with an upper end of said second clip device engaging an upper peripheral edge of said container.

13. The cleaning apparatus of claim 12, wherein each of said first clip device and said second clip device comprises an outwardly curved section that is sized and configured to assist with attaching said first clip device to said first sidewall and said second clip device to said second sidewall and with removing said first slip device from said first sidewall and said second clip device from said second sidewall.

14. The cleaning apparatus of claim 12, wherein each of said first clip device and said second clip device is cooperatively configured with each of said first brush and said second brush so as to define an overlap area wherein said distal end of said bristles of said first brush are disposed in said bristles of said second brush and said distal end of said bristles of said second brush are disposed in said bristles of said first brush when said first brush and said second brush are disposed in said cleaning area of said container.

15. The cleaning apparatus of claim 12, wherein said brush engaging section of each of said first clip device and said second clip device comprises a U-shaped bracket defining a brush receiving area sized and configured to receive and engage said brush body of said one of said first brush and said second brush to support said one of said first brush and said second brush in said cleaning area, wherein said brush body of each of said first brush and said second brush has a slot that is securely engaged by one or more slot engaging protrusions extending into said brush receiving area of each of said brackets to secure said first brush onto said first clip device and said second brush onto said second clip device.

16. The cleaning apparatus of claim 12, wherein said securing mechanism of at least one of said first clip device and said second clip device comprises a wall aperture in at least one of said first sidewall and said second sidewall of said container and a clip protrusion on one of said first clip member and said second clip member of at least one of said first clip device and said second clip device, said clip protrusion positioned so as to extend into said wall engaging area between said first clip member and said second clip member, said clip protrusion sized and configured to be received in said wall aperture so as to securely attach said first clip device or said second clip device to said at least one of said first sidewall and said second sidewall of said container.

17. A cleaning system, comprising:

one of a plate and a utensil, said plate and said utensil having one or more surfaces, each of said plate and said utensil sized and configured to be held by a user;

debris on at least one of said one or more surfaces;

a cleaning apparatus comprising a cleaning area defined by a container having at least a first sidewall and a second sidewall, said second sidewall in opposing relation to said first sidewall, each of said first sidewall and said second sidewall of said container has a notch at an upper peripheral edge thereof, a first brush having a brush body with a plurality of bristles having a proximal end at said brush body and a distal end extending outwardly from said brush body, a first clip device associated with said first brush for mounting said first brush to said first sidewall of said container so as to dispose said first brush in said cleaning area, a second brush having a brush body with a plurality of bristles having a proximal end at said brush body and a distal end extending outwardly from said brush body, and a second clip device associated with said second brush for mounting said second brush to said second sidewall so as to dispose said second brush in said cleaning area, each of said first clip device and said second clip device has a brush engaging section and a container engaging section, said container engaging section of said first clip device sized and configured to be received in said notch of said first sidewall and said container engaging section of said second clip device sized and configured to be received in said notch of said second sidewall so as to secure each of said first clip device and said second clip device to said container, said container engaging section of each of said first clip device and said second clip device having a first clip member and a second clip member defining a wall engaging area therebetween, said wall engaging area of said first clip device sized and configured to receive said first sidewall therein so as to further secure said first clip device to said container with said first brush disposed in said cleaning area of said container, said wall engaging area of said second clip device sized and configured to receive said second sidewall therein so as to further secure said second clip device to said container with said second brush disposed in said cleaning area of said container, said brush engaging section of each of said first clip device and said second clip device are cooperatively structured and arranged to dispose said bristles of said first brush generally toward said bristles of said second brush when each of said first brush and said second brush are placed in said cleaning area such that when the user holds said plate and pushes said plate through said bristles of said first brush and said second brush said bristles of at least one of said first brush and said second brush will remove said debris from said plate; and a liquid in said cleaning area, said liquid being at or above said first brush and said second brush.

18. The cleaning system of claim 17 further comprising a securing mechanism associated with said first clip device to securely attach said first clip device to said first sidewall of said container and a securing mechanism associated with said second clip device to securely attach said second clip device to said second sidewall of said container.

19. The cleaning apparatus of claim 18, wherein said securing mechanism comprises a wall aperture in at least one of said first sidewall and said second sidewall of said container and a clip protrusion on one of said first clip member and said second clip member of at least one of said first clip device and said second clip device, said clip protrusion positioned so as to extend into said wall engaging area between said first clip member and said second clip member, said clip protrusion sized and configured to be received in said wall aperture so as to securely attach said first clip device or said second clip device to said at least one of said first sidewall and said second sidewall of said container.

20. The cleaning system of claim 17, wherein said brush engaging section of each of said first clip device and said second clip device comprises a U-shaped bracket defining a brush receiving area sized and configured to receive and engage said brush body of said one of said first brush and said second brush to support said one of said first brush and said second brush in said cleaning area, wherein said brush body of each of said first brush and said second brush has a slot that is securely engaged by one or more slot engaging protrusions extending into said brush receiving area of each of said brackets to secure said first brush onto said first clip device and said second brush onto said second clip device.

* * * * *